US008207801B2

(12) United States Patent
Sterns et al.

(10) Patent No.: US 8,207,801 B2
(45) Date of Patent: Jun. 26, 2012

(54) FERRITE FILTER COMPRISING APERTURE-COUPLED FIN LINES

(75) Inventors: Michael Sterns, Erlangen (DE); Dirk Schneiderbanger, Erlangen (DE); Robert Rehner, Nuremberg (DE); Lorenz-Peter Schmidt, Hessdorf (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 768 days.

(21) Appl. No.: 12/298,820

(22) PCT Filed: Dec. 6, 2007

(86) PCT No.: PCT/EP2007/010633

§ 371 (c)(1),
(2), (4) Date: Nov. 5, 2008

(87) PCT Pub. No.: WO2008/068025

PCT Pub. Date: Jun. 12, 2008

(65) Prior Publication Data

US 2009/0179717 A1 Jul. 16, 2009

(30) Foreign Application Priority Data

Dec. 6, 2006 (DE) ..... 10 2006 058 227

(51) Int. Cl.
*H01P 1/218* (2006.01)
*H01P 7/00* (2006.01)

(52) U.S. Cl. ..... 333/202; 333/219.2

(58) Field of Classification Search ..... 333/185, 333/174, 175, 202–212, 219, 219.2, 235
See application file for complete search history.

(56) References Cited

U.S. PATENT DOCUMENTS

| | | | | | |
|---|---|---|---|---|---|
| 3,085,213 | A | * | 4/1963 | Walker | 333/101 |
| 3,748,605 | A | * | 7/1973 | Baynham et al. | 333/209 |
| 4,375,054 | A | * | 2/1983 | Pavio | 333/116 |
| 4,888,569 | A | | 12/1989 | Nicholson et al. | |
| 5,949,382 | A | * | 9/1999 | Quan | 343/767 |
| 6,093,886 | A | * | 7/2000 | Bazizi et al. | 174/31 R |

OTHER PUBLICATIONS

Carter, "Side-Wall-Coupled, Strip-Transmission-Line Magnetically Tunable Filters Employing Ferrimagnetic YIG Resonators," *IEEE Transactions on Microwave Theory and Techniques*, MTT-13:306-315 (1965).

Uher et al., "Computer-Aided Design and Improved Performance of Tunable Ferrite-Loaded E-Plane Integrated Circuit Filters for Millimeter-Wave Applications," *IEEE Transactions on Microwave Theory and Techniques*, 36:1841-1849 (1988).

International Search Report for PCT/EP2007/010633 dated Apr. 3, 2008.

* cited by examiner

*Primary Examiner* — Benny Lee
*Assistant Examiner* — Gerald Stevens
(74) *Attorney, Agent, or Firm* — Marshall, Gerstein & Borun LLP

(57) ABSTRACT

A magnetically-tunable filter comprising a filter housing with two tunable resonator spheres made of magnetizable material, which are disposed one above the other in two filter arms. At least one filter arm provides a fin line or slot line disposed on a substrate layer and extending in the direction towards an electrical contact, and a common coupling aperture, thereby connecting the two filter arms to one another. In this context, one resonator sphere is positioned within each filter arm on each of the two sides of the coupling aperture.

42 Claims, 17 Drawing Sheets

At 50GHz:

At 60GHz:

At 70GHz:

FERRITE FILTER COMPRISING APERTURE-COUPLED FIN LINES

BACKGROUND OF THE INVENTION

According to the prior art, tunable band-pass filters comprise resonator elements made of ferrites, in which the resonance frequency is adjusted via an external DC magnetic field. The resonators are generally spherical, because this shape can be manufactured using relatively-simple techniques with the dimensions required for use at high frequencies (diameter of sphere ≦0.3 mm). One reason for using spherical resonators is the linear relationship between the resonance frequency and the modulus of the external DC magnetic field.

Yttrium iron garnet (YIG) is used as the material for the resonators at frequencies up to approximately 50 GHz. For frequencies above 50 GHz, the use of hexaferrites has proved preferred. Because of their crystalline structure, hexaferrites provide an anisotropic field, which, with a corresponding orientation relative to the external DC magnetic field, allows the adjustment of high resonance frequencies with significantly-lower field strengths of the DC magnetic field than is possible when using YIG. This property of hexaferrites, allows an avoidance according to the prior art of the technically-demanding generation of high magnetic-field strengths for the adjustment of high resonance frequencies.

Shielded (suspended) striplines are disposed, for example, in channels milled entirely into metal. These channels are connected to one another exclusively via a circular coupling aperture (iris). The prior art assumes that the lines are disposed perpendicular to one another, which leads to high decoupling outside the resonance in view of the orthogonality of the electromagnetic fields. As in case of many other coupler structures according to the prior art, the spheres within the structure are attached in the proximity of a short-circuit. The reason for this is that the resonators, especially the resonator spheres, are coupled via the magnetic field (HF field), which is maximal in the region of the short circuit. Since, according to the prior art, this maximum occurs in the region of the short circuit independently of the frequency, a good coupling of the spheres is achieved over a large frequency range in resonant conditions.

Furthermore, by contrast with non-resonant conditions, field energy supplied through the ferrite properties of the spheres in resonant conditions is radiated in the direction of the diaphragm, thereby leading to an increased energy transfer between the filter input and the filter output.

One possibility according to the prior art for reducing the insertion loss of the filter under otherwise identical conditions (identical line width of the resonance curve of the resonator, identical saturation magnetization of the resonator and identical diameter of the iris) is the use of inverse shielded (suspended) striplines. With this type of line, the middle conductor is attached to the side of the substrate directed towards the resonator or respectively the resonator sphere, wherein the resonators continue to be disposed in the region of the short circuit and to provide the disadvantages associated with this.

In the context of the prior art, it is dispreferred if the magnetic field provides a considerable component parallel to the direction of transport of the decoupled wave in the short-circuited region of two metallic strips within the proximity of the coupling. As a result, disturbing auxiliary modes can be excited by the coupling.

U.S. Pat. No. 4,888,569 B1 specifies coupler structures with four resonator spheres for use in magnetically-tunable filters. By way of example, this patent discloses a variable band-pass filter for frequencies within a maximum frequency range of one waveguide band, for example, 50-75 GHz. The variable band-pass filter comprises an input waveguide, an output waveguide and a transition waveguide, which are designed for the propagation of a $TE_{10}$ wave mode. During the operation of the filter, the end of the input waveguide terminated with a short-circuit wall, the beginning of the output waveguide, which is also provided with a short-circuit wall, and the transition waveguide attached in the direction towards the externally-applied, homogenous magnetic field below the input waveguide and the output waveguide, are arranged between two magnetic poles, which supply the variable magnetic field for the adjustment of a resonance frequency. The input waveguide and output waveguide provide a rectangular profile in the direction of the wave propagation, which provides a significantly-smaller cross-sectional area in the coupling region than at the connecting flange. The coupling region of the variable band-pass filter encloses the four resonator spheres attached in the proximity of a short-circuit wall and respectively the tapering end of the input waveguide and output waveguide, and the transition waveguide with a constant cross-sectional area.

One disadvantage of the variable band-pass filter described in U.S. Pat. No. 4,888,569 B1 is that in resonant conditions, the field distribution of the wave to be decoupled is unfavorable in the coupling region, because the wave is conducted in a waveguide, of which the profile tapers towards the coupling region in a direction perpendicular to the direction of propagation of the wave to be decoupled. As a result, undesirable reflections occur, which overlap in a destructive manner and therefore reduce the amount of energy transported by the incoming wave. This effect also relates to the outgoing wave in the output waveguide, which now provides a defined frequency. Accordingly, the overall insertion loss relative to the input of the input waveguide and the output of the output waveguide is increased, because the field distributions in the coupling region are disturbed by the tapering geometry of the waveguides.

One further disadvantage is the limited bandwidth of the waveguide concept.

SUMMARY OF THE INVENTION

The invention therefore provides a magnetically-tunable filter for high-frequencies, which, in resonant conditions, provides the lowest possible insertion loss and in decoupling conditions provides a very high isolation of the filter input and filter output, and of which the coupling structure does not excite any disturbing auxiliary modes.

Accordingly, the invention provides a magnetically-tunable filter comprising a filter housing with two tunable resonator spheres made of magnetizable material, which are arranged one above the other in two filter arms, wherein at least one of the filter arms contains a substrate layer, which provides a fin line or slot line extending toward an electrical contact, wherein the two filter arms are connected by a common coupling aperture, and one resonator sphere is positioned within each of the two filter arms on each side of the coupling aperture.

The filter according to the invention is integrated within a filter housing with two filter arms and provides two tunable resonator spheres made from a magnetizable material, which are disposed one above the other within the two filter arms. At least one of the filter arms preferably provides a substrate layer, which is coated with a fin line or slotted conductor extending in the direction towards an electrical contact. Both filter arms are connected by a coupling aperture, wherein one resonator sphere is positioned on each side of the coupling aperture within each of the two filter arms.

One particular advantage of the use of a fin line for the magnetically-tunable filter according to the invention results from the weak components of the HF field magnetic (high-frequency field) in the direction of propagation of the decoupled electromagnetic waves (x-direction). The magnetic field in the region of the resonator sphere preferably provides only one very weak component in the x-direction. As a result of these properties of the field distribution, the 210-auxiliary mode is excited only very weakly, so that the undesired auxiliary resonance preferably appears in the resonance curve only in a considerably weakened form.

Moreover, it is preferred that both filter arms are disposed one above the other, so that the two resonator spheres are now no longer positioned side-by-side but rather one above the other. This provision is associated with further advantages in the integration of the filter according to the invention together with further components within a combined housing. Accordingly, in a housing with a given, restricted base area, more components can now be included around the filter according to the invention, because this filter preferably provides a reduced lateral extension.

The internal structures, which are defined by a sequence of different layers, are preferably structured in a similar manner in both filter arms, which simplifies the manufacture of the filter according to the invention.

A realization of the coupling aperture as a single gap or as an apertured diaphragm with any required open cross section is similarly simple to manufacture.

The coupling aperture preferably provides an open cross-section, of which the area corresponds at least to the area of an equatorial surface of a resonator sphere. This guarantees that inhomogeneous field areas (edge effects) are shielded from the walls beyond the coupling aperture, so that the coupling mechanism via electron-spin resonance can occur only within a homogeneous field region, in which the two resonator spheres are disposed.

It is additionally preferred that the metal strips of the fin line are soldered laterally with indium solder.

Moreover, it is preferred that each resonator sphere is arranged within the filter arm above an open-circuit region, wherein the open-circuit region isolates the metal strips of the fin line at its ends relative to one another and at the same time also forms an isolated region relative to the walls of the filter housing. An arrangement of this kind preferably reduces the amount of the HF magnetic-field component, which causes disturbing auxiliary modes in the decoupled electromagnetic wave.

It is also preferred that one filter arm is composed of two cuboids of different sizes, so that the substrate layer is formed on the smaller cuboid. This guarantees a stable attachment of the substrate layer within a filter arm.

The layer thickness of the substrate layer can expediently be varied, so that the magnetically-tunable filter according to the invention can preferably be used in different frequency ranges. The dielectric constant of the material, of which the substrate layer is made is preferably low.

The metal strips of the fin line are preferably built up on a substrate of TEFLON (Polytetrafluoroethylene), because TEFLON (Polytetrafluoroethylene) has the property that it can be clamped in a stable manner in the filter arm.

By preference, the resonator spheres have a diameter of approximately 300 μm, this size being still readily handled during manufacture.

A mirror-image arrangement of the resonator spheres on both sides of the coupling aperture is also preferred, because this contributes to reducing the cost of adjustment. In particular, it is preferred if the resonator spheres are each glued directly onto the substrate layer, thereby avoiding the cost of attaching an appropriate mounting, which, once again, preferably facilitates the assembly of the filter according to the invention.

One further advantage of the filter according to the invention is that the resonator spheres in the filter arms are arranged with different internal structures. Accordingly, a magnetically-tunable filter according to the invention, which consists of an aperture-coupled microstripline and a unilateral fin line, achieves a stretched geometry with a reduced overall height. The filter according to the invention is therefore easier to install as a whole in a narrow slit between the pole shoes of an electromagnet. With a small distance between the pole shoes, high magnetic-field strengths can be generated at a reduced cost and therefore more readily. A small spacing distance preferably has a positive effect on the homogeneity of the DC magnetic field.

BRIEF DESCRIPTION OF THE DRAWINGS

The structure and also the method of operation of the invention and its further advantages and objects are best understood with reference to the following description in conjunction with the associated drawings. The drawings are as follows.

DETAILED DESCRIPTION

By way of explanation of the magnetically-tunable filter according to the invention, the following section initially describes the structures conventional at the time of the invention and their disadvantages with reference to FIGS. 1 to 8. With reference to FIG. 9, a first exemplary embodiment of the magnetically-tunable filter 1 according to the invention will then be described in greater detail. In the description of the formerly-conventional structures and of the exemplary embodiments of the present invention, identical reference numbers will be used for functionally-identical elements.

Figure 1:
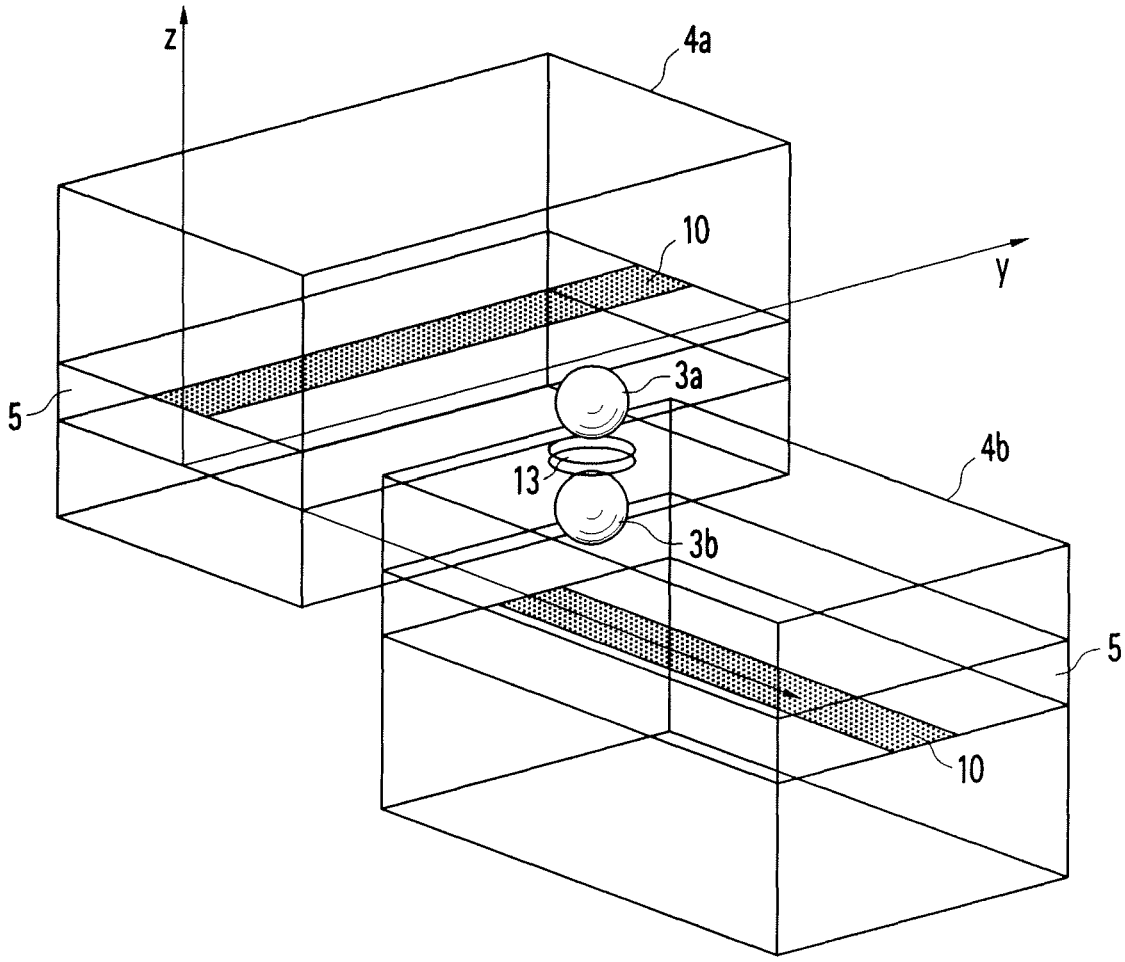
Fig. 1 Prior art
FIG. 1 shows a structure of formerly-conventional aperture-coupled, shielded (suspended) strip lines.

FIG. 1 shows a formerly-conventional structure of aperture-coupled, shielded (suspended) striplines, wherein a coupling structure consisting of two resonator spheres 3*a*, 3*b* disposed one above the other and separated by an apertured diaphragm 13 is used for coupling connecting resonators.

The external DC magnetic field $H_0$ for tuning the resonance frequency is aligned parallel to the z axis of the coordinate system shown in FIG. 1.

Figure 2:
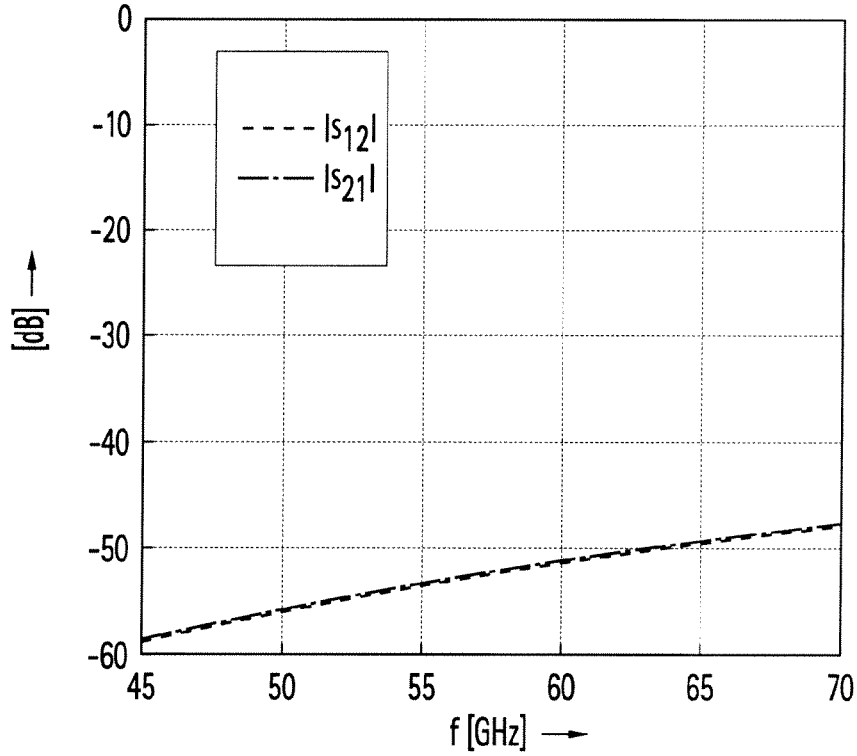
Fig. 2 Prior art
FIG. 2 shows the dependence of the isolation of the striplines illustrated in FIG. 1 upon the frequency.

FIG. 2 shows the dependence of the isolation of the striplines illustrated in FIG. 1 upon the frequency of the coupled electromagnetic waves over a frequency range from 50-70 GHz. The illustrated curve of the isolation is obtained with the DC magnetic field $H_0$ switched off. With a sufficiently-wide spacing from the main resonance frequency, that is to say, if the frequency of the incident electromagnetic waves is not disposed in the proximity of the main resonance frequency, the characteristic of the S-parameter |s21| or respectively |s12| approximates to the characteristic of the isolation curve.

Figure 3:
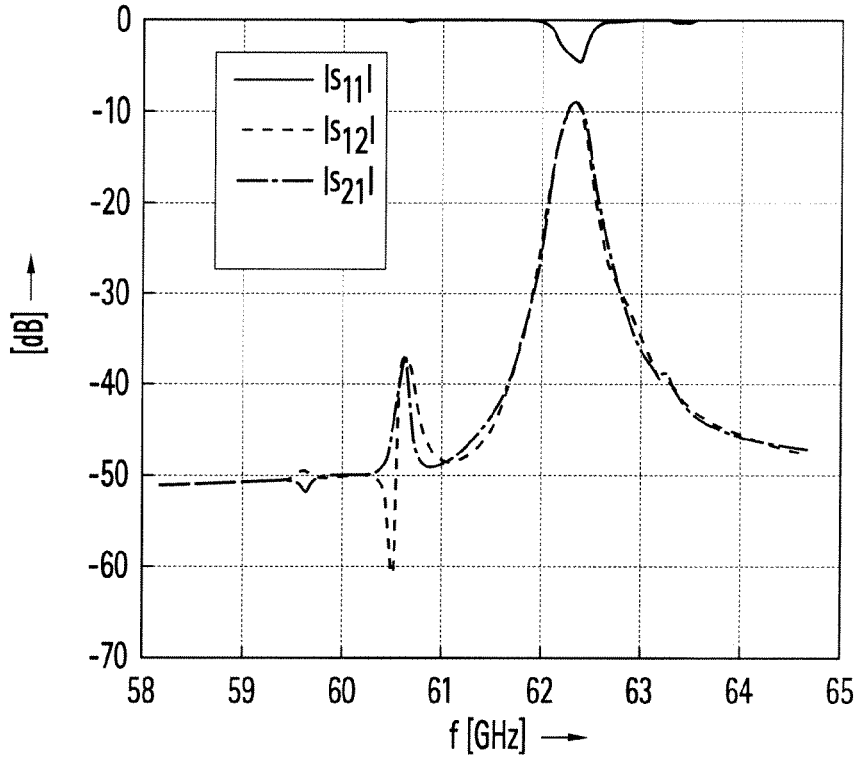
Fig. 3 Prior art
FIG. 3 shows a resonance characteristic of the striplines illustrated in FIG. 1 dependent upon frequency.

FIG. 3 shows a resonance characteristic of the striplines illustrated in FIG. 1 dependent upon the frequency of the incident electromagnetic wave. The disturbing auxiliary mode 210 is prominent just below a frequency of 61 GHz.

Figure 4:
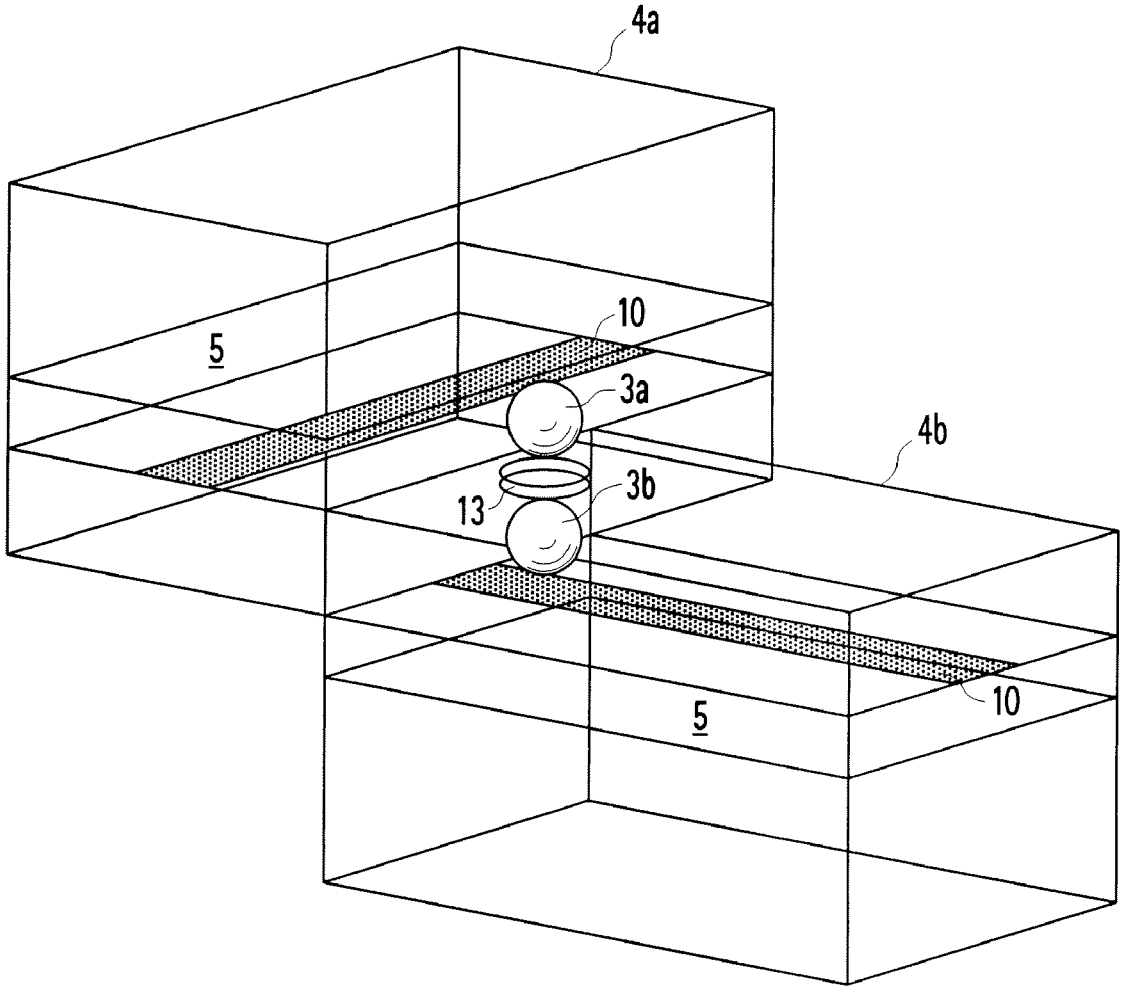
Fig. 4 Prior art
FIG. 4 shows an inverse structure of formerly-conventional aperture-coupled, shielded (suspended) striplines.

FIG. 4 shows a formerly-conventional structure of an aperture-coupled, shielded (suspended) stripline in an inverse structure. The difference by comparison with FIG. 1 is that, with the inverse structure of this stripline, both metallization 10 are disposed respectively on the opposite surface of the substrate layer 5.

Figure 5:
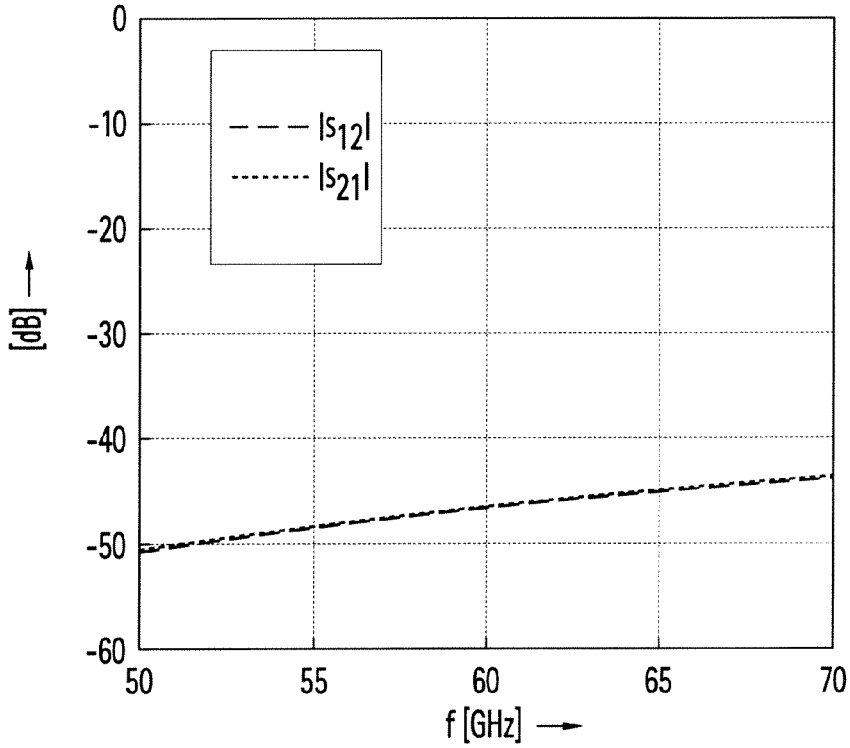
Fig. 5 Prior art
FIG. 5 shows the dependence of the isolation of the inverse striplines illustrated in FIG. 4 upon frequency.

FIG. 5 shows the dependence of the isolation of the inverse striplines illustrated in FIG. 4 upon the frequency. As a result of the concentration of the field energy in the region of the coupling aperture (apertured diaphragm 13), a reduced decoupling is achieved with the striplines in an inverse structure by comparison with the use of the shielded (suspended) striplines.

Figure 6:
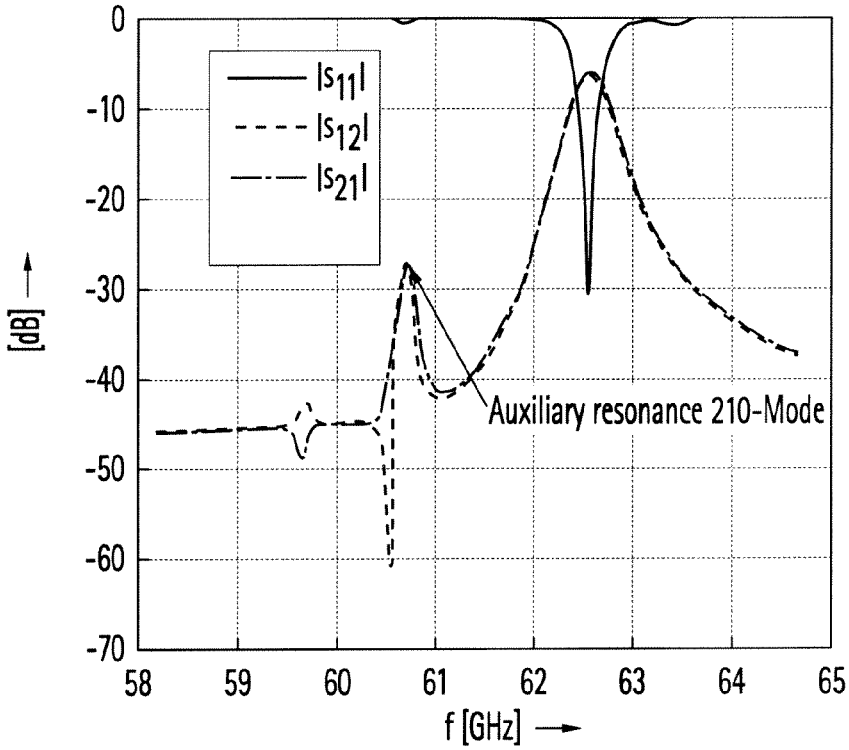
Fig. 6 Prior art
FIG. 6 shows a resonance characteristic of the striplines illustrated in FIG. 4 dependent upon frequency.

FIG. 6 shows a resonance characteristic of the striplines illustrated in FIG. 4 dependent upon the frequency, wherein the disturbing 210 auxiliary mode is significantly more prominent below a frequency of 61 GHz than in the characteristic of the resonance curve in FIG. 3. In the resonance characteristic of FIG. 6, it is evident that a reduced insertion loss in the pass-band range is achieved as a result. Furthermore, the auxiliary resonance (210 mode) occurring below the main resonance is clearly evident. This undesirable auxiliary resonance occurs as a result of inhomogeneities of the high-frequency magnetic field. The distribution of the $m_x$ component of the magnetization of the 210 mode in the interior of a resonator sphere 3*a*, 3*b* is illustrated in FIG. 7.

Figure 7:
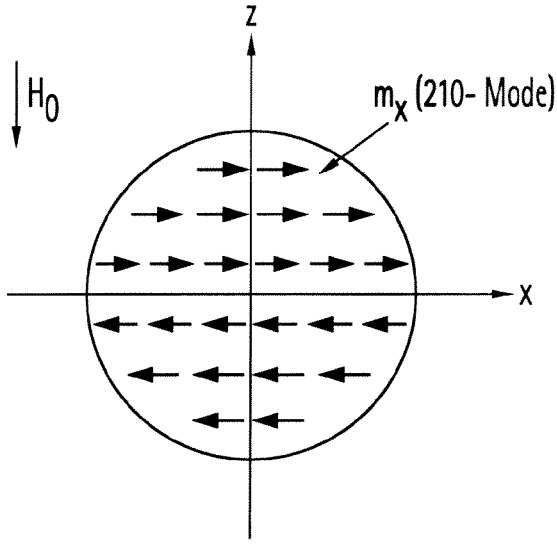
Fig. 7 Prior art
FIG. 7 shows a distribution of the $m_x$-component of the 210 wave mode in the interior of a resonator sphere.

By way of explanation of this auxiliary mode, FIG. 7 shows a distribution of the $m_x$ component of the 210 wave mode in the interior of a resonator sphere 3*a*, 3*b*. It is clearly evident that a resulting $m_x$ component, which determines the occurrence of the interfering 210 auxiliary mode, predominates in the respective hemispheres.

Figure 8:
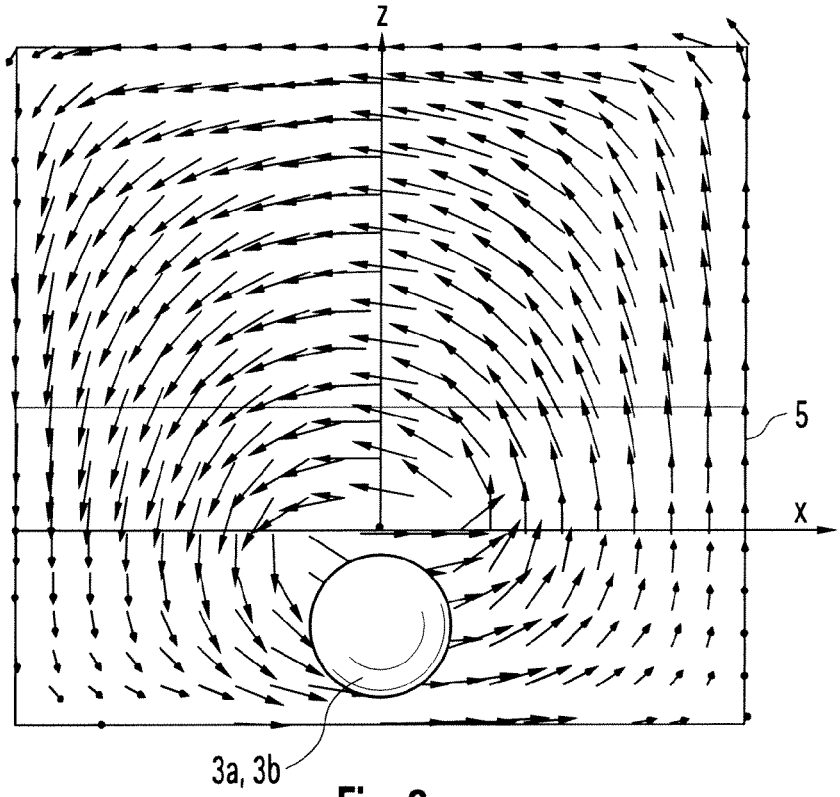
Fig. 8 Prior art
FIG. 8 shows a local distribution of the magnetic field of a conventional, inverse, shielded (suspended) stripline in the region of the resonator sphere.
Figure 9:
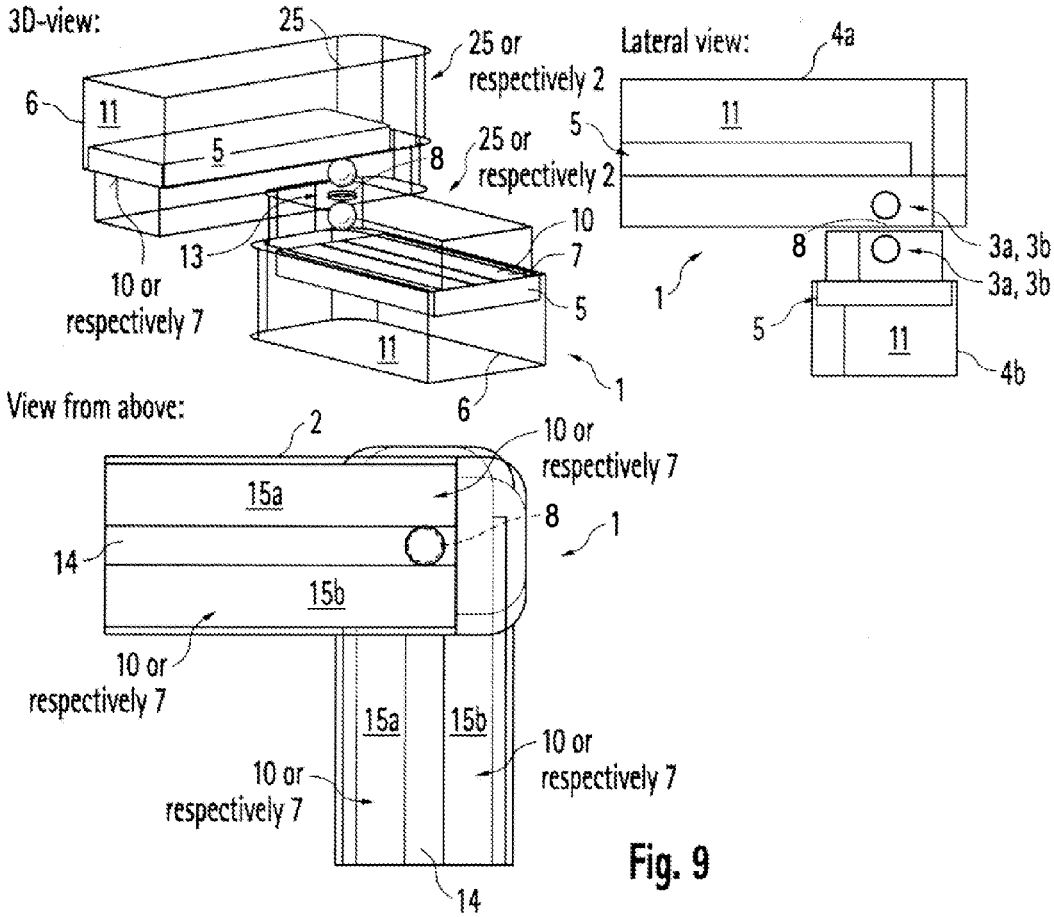
FIG. 9 shows a first exemplary embodiment of a magnetically-tunable filter according to the invention with a unilateral fin line.

FIG. 8 shows a local distribution of the magnetic field of a conventional, inverse (suspended) stripline in the region of the resonator sphere 3*a*, 3*b*. The excitation of the 210 mode is favored by inhomogeneities of the x-component of the high-frequency magnetic field. As is evident from FIG. 8, the x-component of the magnetic field is particularly prominent with a (suspended) stripline, for which reason a strong excitation of the 210 mode is also obtained. A line structure with an x-component of the magnetic field, which is only very weakly prominent or not prominent at all, is required in order to suppress the 210 mode in an improved manner. This property is achieved by fin lines, which are used in a magnetically-tunable filter according to the invention.

FIG. 9 shows a first exemplary embodiment of a magnetically-tunable filter 1 according to the invention. The filter 1 according to the invention is integrated in a filter housing 2 with two filter arms 4*a*, 4*b* and provides two tunable resonator spheres 3*a*, 3*b* made of magnetic material, which are disposed one above the other in the two filter arms 4*a*, 4*b*. At least one of the filter arms 4*a*, 4*b* provides a substrate layer 5, on which a fin line 7 or a slot line extending in the direction towards an electrical contact 6 is arranged. Both filter arms 4*a*, 4*b* are disposed one above the other and connected through a shared coupling aperture 8, wherein one resonator sphere 3*a*, 3*b* is positioned on each side of the coupling aperture 8 in each of the two filter arms 4*a*, 4*b*. Both filter arms 4*a*, 4*b* provide an internal structure, which is defined by a sequence of different layers. The different layers comprise the substrate layer 5 with a metallization layer 10 and an air layer 11, which surrounds the other layers. The substrate layer 5 itself provides a variable layer thickness. In this first exemplary embodiment of the filter 1 according to the invention, the internal structures of both filter arms 4*a*, 4*b* are mutually symmetrical. A unilateral fin line 7 is provided as the line structure.

The substrate layers 5 of the two filter arms 4*a*, 4*b* are disposed respectively in two propagation channels milled or eroded from metal, which are connected to one another exclusively via a circular opening or an apertured diaphragm 13. The apertured diaphragm 13 according to the invention provides an open cross-section, of which the area corresponds at least to the area of an equatorial surface of a resonator sphere 3*a*, 3*b*. The resonator spheres 3*a*, 3*b*, which are made of a ferrimagnetic or a ferromagnetic material, in particular, a ferrite, are positioned on opposing sides, in mirror-image symmetry to one another on both sides of the coupling aperture 8 or respectively of the apertured diaphragm within an open-circuit region 17 of the fin lines 7. The coupling of the resonator spheres 3*a*, 3*b* via an open-circuit region 17 differs significantly from conventional designs, in which the resonator spheres 3*a*, 3*b*, which provide a diameter within the range from 100 μm to 1000 μm, are coupled in the region of a short-circuit.

The coupling aperture 8 common to the two filter arms 4*a*, 4*b* can also be realized as a combination of an apertured diaphragm 13 with at least one single gap 12.

Figure 10:
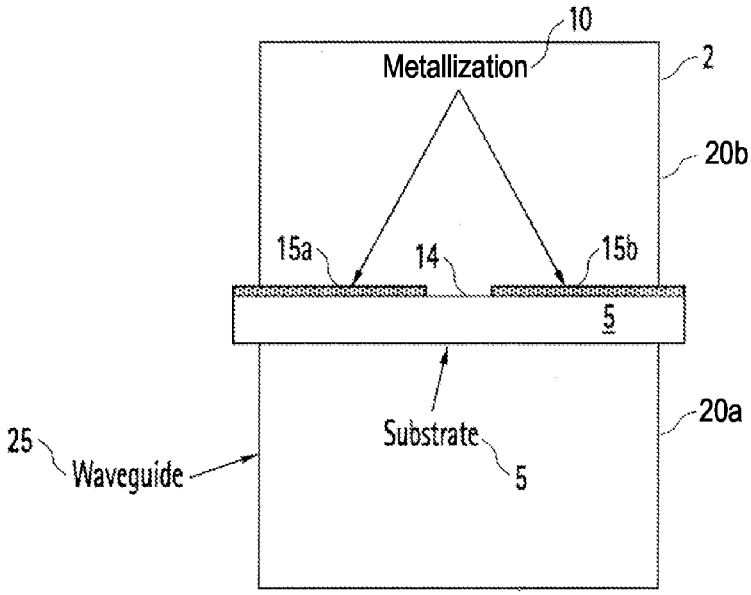
FIG. 10 shows an exemplary cross-section through a unilateral fin line.

FIG. 10 shows an exemplary cross-section through a classic, unilateral fin line 7, wherein the substrate layer 5 is attached symmetrically to a central plane 21 of a waveguide 25 with a rectangular, similarly-symmetrical cross-section. With a unilateral fin line 7, two metal strips 15*a*, 15*b* separated by a non-conductive strip 14 are disposed jointly on a first surface 16*a* of the substrate layer 5.

With a bilateral fin line 7, which is not illustrated in the drawings, two metal strips 15*a*, 15*b* separated by a non-conductive strip 14 are disposed jointly on a first surface 16*a* of the substrate layer 5, wherein, at the same time, a second surface 16*b* of the substrate layer 5 provides at least one metal strip 15*c*.

By contrast with this classic, unilateral fin line 7, wherein the substrate layer 5 is preferably attached in the middle of the waveguide 25, which surrounds it, the substrate layer 5 in the magnetically-tunable filter 1 according to the invention is positioned with a displacement in the direction towards the aperture or respectively towards a coupling aperture 8. As a result of this arrangement of the substrate layer 5, the spacing distance between the substrate layer 5 and the coupling aperture 8, which is designed in this first exemplary embodiment as an apertured diaphragm 13 or respectively as an iris, is reduced, in order to guarantee a good coupling between both resonator spheres 3*a*, 3*b* in resonant conditions.

The entire propagation channel for the electromagnetic waves to be transported is designed in a stepped manner, which means that in each case one filter arm 4*a*, 4*b* is composed of a relatively-larger cuboid 20*a* and a relatively-smaller cuboid 20*b*, so that the substrate layer 5 with its additional layers applied can be simply attached to the relatively-smaller cuboid 20*b*. As a result, a stable support of the substrate layer 5 within the waveguide 25 or respectively within the propagation channel is achieved. The fixing of the substrate layer 5 in the propagation channel or respectively in the waveguide 25 can be implemented, for example, by means of a conductive adhesive, which is applied to the lateral edges 26 at the limit between the relatively-larger cuboid 20*a* and the relatively-smaller cuboid 20*b*. According to the invention, the conductive connection of the lateral metallization to the surrounding waveguide 25 prevents the propagation of undesired modes. The DC magnetic field $H_0$, with which the filter 1 according to the invention is tuned, is disposed perpendicular to the substrate layer 5.

Quartz, ceramic or a similar material, which provides a low dielectric coefficient $\in_r$, is provided as the substrate layer 5. With substrate layers 5 made of the named materials, the line wavelength is longer than when using substrate materials with a high dielectric coefficient $\in_r$. The relatively-longer line wavelength provides the advantage that the magnetic field in the interior of the resonator sphere 3*a*, 3*b* is more homogeneous, and accordingly, the excitation of magnetostatic modes of a relatively higher order, which are noticed as interfering, auxiliary resonances, is reduced.

Figure 11:
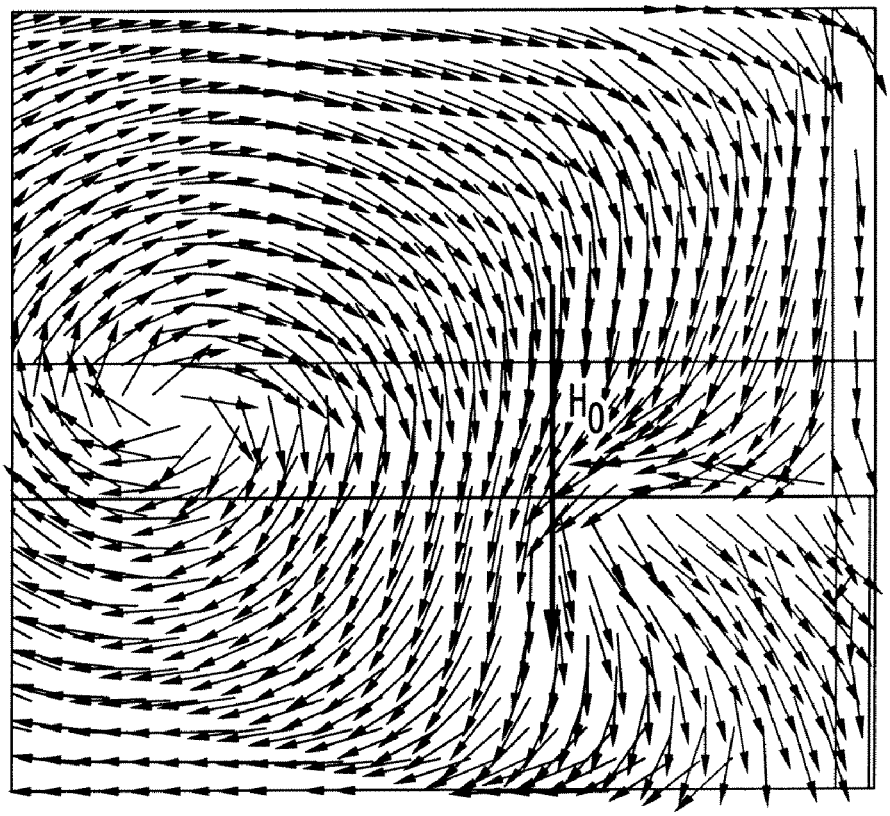
FIG. 11 shows a local distribution of the magnetic field in the region of the short-circuit of a unilateral fin line as an example for an improved understanding of the present invention.

As an example by way of explanation of the present invention, FIG. 11 shows a local distribution of the magnetic field in the short-circuit region of a unilateral fin line 7. The unilateral fin line 7 causes the x-component of the magnetic field to be less prominent than in the case of a shielded (suspended) stripline of inverse design, which is shown in FIG. 8.

Figure 12:
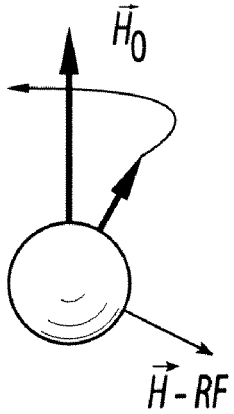
FIG. 12 shows the relationship between a DC magnetic field and a high-frequency magnetic field upon the excitation of electron-spin resonance as an example for an improved understanding of the present invention.

According to the invention, the coupling of the resonator spheres 3*a*, 3*b* is implemented via an open-circuit region 17 of the two lateral metal strips 15*a*, 15*b*. On one hand, the open-circuit region 17 isolates the ends of both metal strips 15*a*, 15*b* relative to one another and, on the other hand, also relative to a wall 18 of the filter housing 2. The reasons for this type of coupling will be explained in greater detail below. FIG. 11 shows clearly that, at the short-circuit, the field lines of the high-frequency magnetic field are disposed parallel to the external DC magnetic field $H_0$. In order to excite in the resonator sphere 3*a*, 3*b* or respectively in the ferrite sphere electron spins, which are responsible for the occurrence of the resonance, the RF magnetic field in the region of the sphere must be disposed perpendicular to the external DC magnetic field $H_0$, which is illustrated in FIG. 12.

As an example by way of explanation of the present invention and, in particular, by way of explanation of the factual situation described above, FIG. 12 shows the relationship between a DC magnetic field $H_0$ and a high-frequency magnetic field (HF field) upon the excitation of the electron spin resonance.

Figure 13:
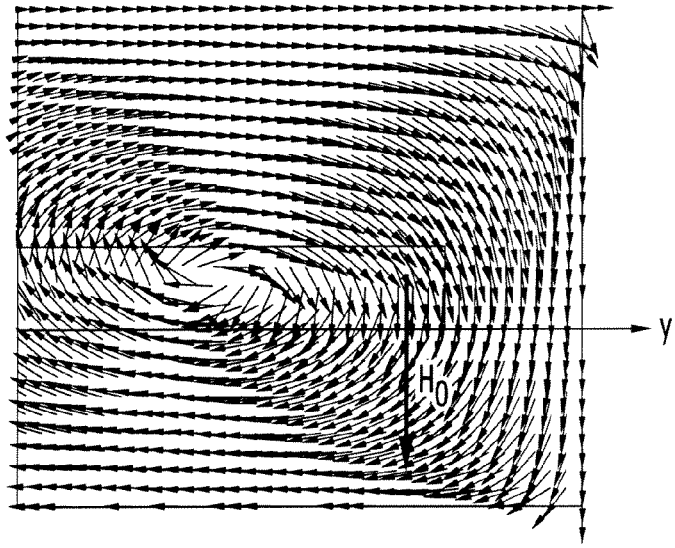
FIG. 13 shows three local distributions of the magnetic field in the open-circuit region of a unilateral fin line of a first exemplary embodiment of the magnetically-tunable filter according to the invention at 50 GHz, 60 GHz and 70 GHz.
Figure 13:
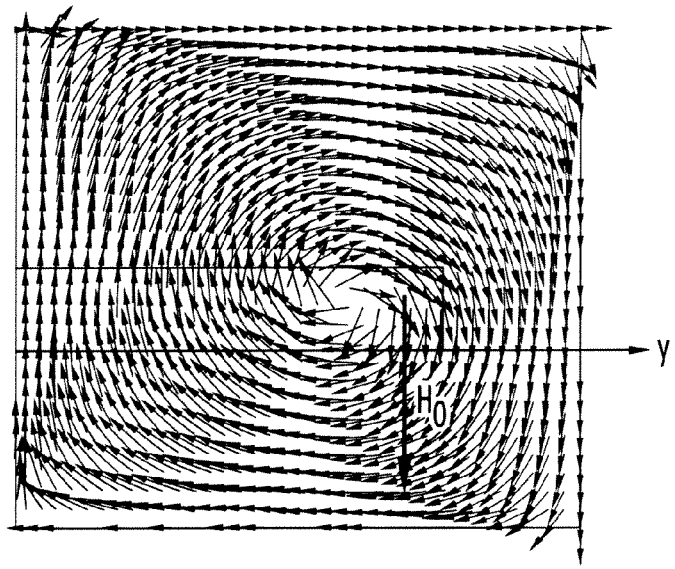
Figure 13:
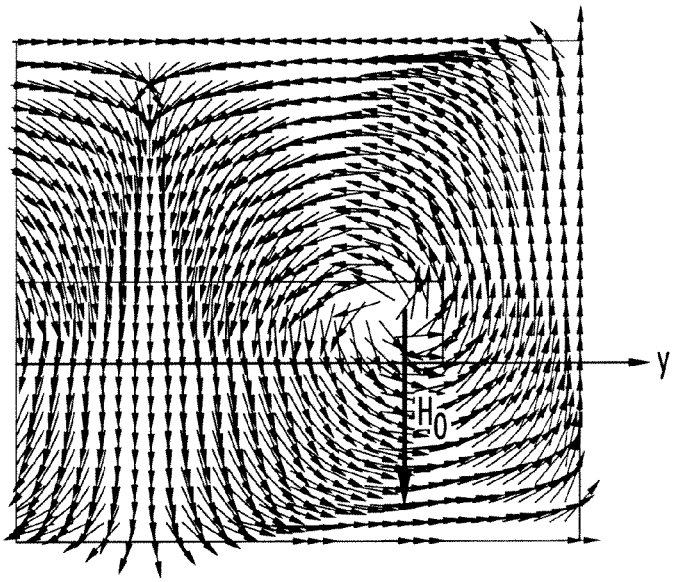

FIG. 13 shows three local distributions of the magnetic field in the open-circuit region 17 of the unilateral fin line 7 of the first exemplary embodiment of the magnetically-tunable filter 1 according to the invention at the frequencies 50 GHz, 60 GHz and 70 GHz. As a result of the formation of an open-circuit region 17, the proportion of the component of the high-frequency magnetic field perpendicular to the DC magnetic field in the region of the resonator spheres 3*a*, 3*b* is more strongly prominent. Accordingly, a good excitation of the electron spin and therefore a good coupling of the resonator spheres 3*a*, 3*b* is achieved. This guarantees the required field distribution in the region of the resonator spheres 3*a*, 3*b* over a broad bandwidth, as shown in FIG. 13. In this context, it is evident that the magnetic-field component of the high-frequency field, which is disposed perpendicular to the external DC magnetic field $H_0$, predominates with an increasing spacing distance relative to the substrate layer 5; it is therefore favorable to position the resonator spheres 3*a*, 3*b* at a sufficiently-large spacing distance relative to the substrate layer 5. The aligned resonator spheres 3*a*, 3*b* are attached in a mounting made of non-conductive material, which will not be explained in greater detail at present.

Figure 14:
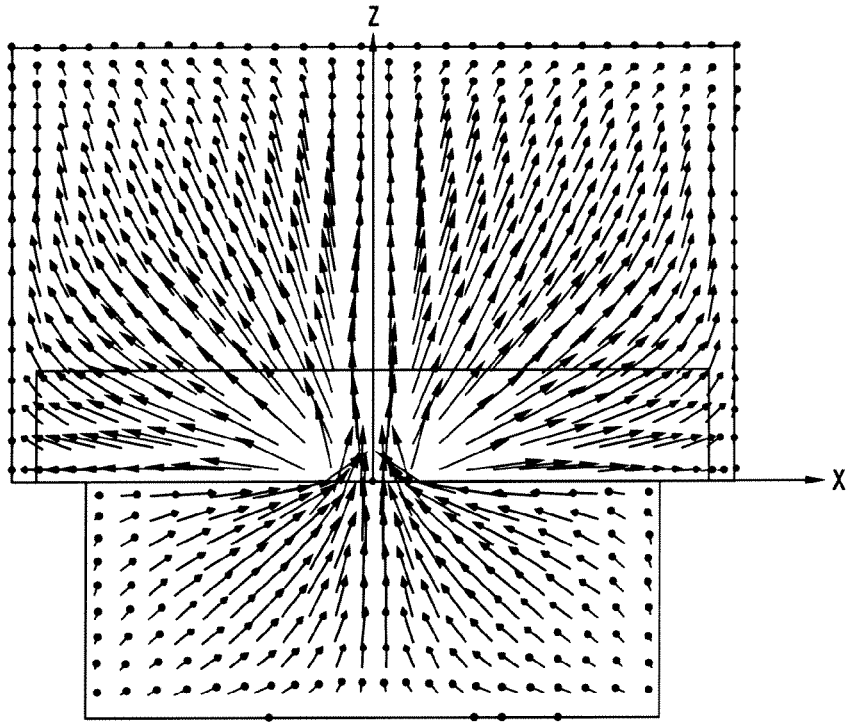
FIG. 14 shows a local distribution of the magnetic field of a second exemplary embodiment of the magnetically-tunable filter according to the invention with an antipodal fin line.

FIG. 14 shows a local distribution of the magnetic field of a second exemplary embodiment of the magnetically-tunable filter 1 according to the invention with an antipodal fin line 7*a*. This drawing shows that it is favorable to position the resonator spheres 3*a*, 3*b* along the z-axis, because the magnetic field in this region provides a negligibly-small x-component.

Figure 15:
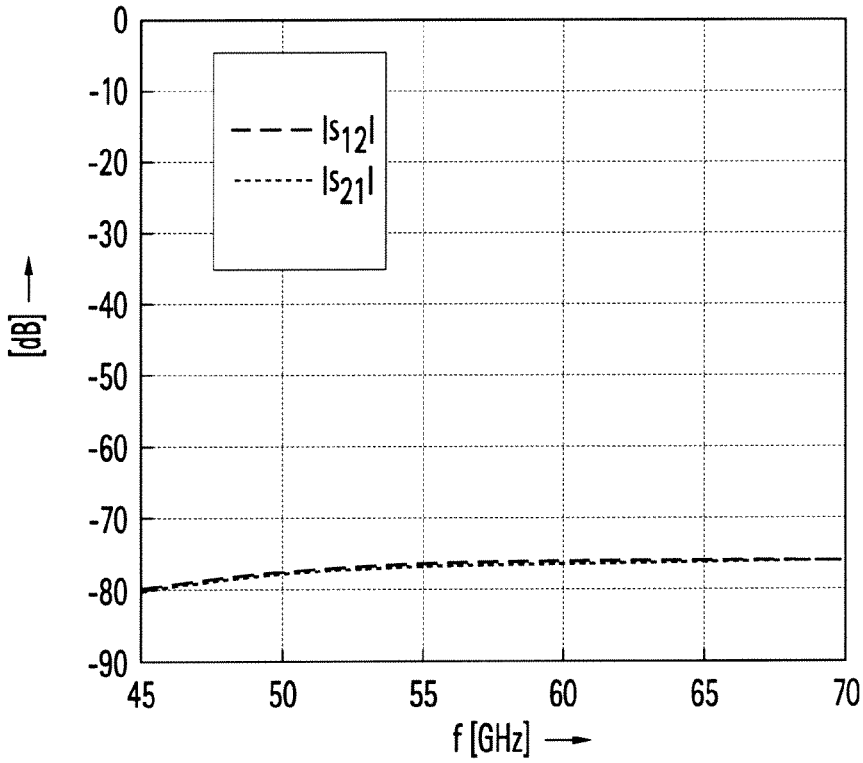
FIG. 15 shows the dependence of the isolation of the magnetic field according to the invention upon frequency.

FIG. 15 shows the dependence of the isolation of the magnetic filter according to the invention upon the frequency, wherein the loss (−75 dB) here is superior by several orders of magnitude to a formerly-conventional filter, as shown by the isolation curves in FIG. 2 (approximately −55 dB) and respectively in FIG. 5 (approximately −45 dB).

Figure 16:
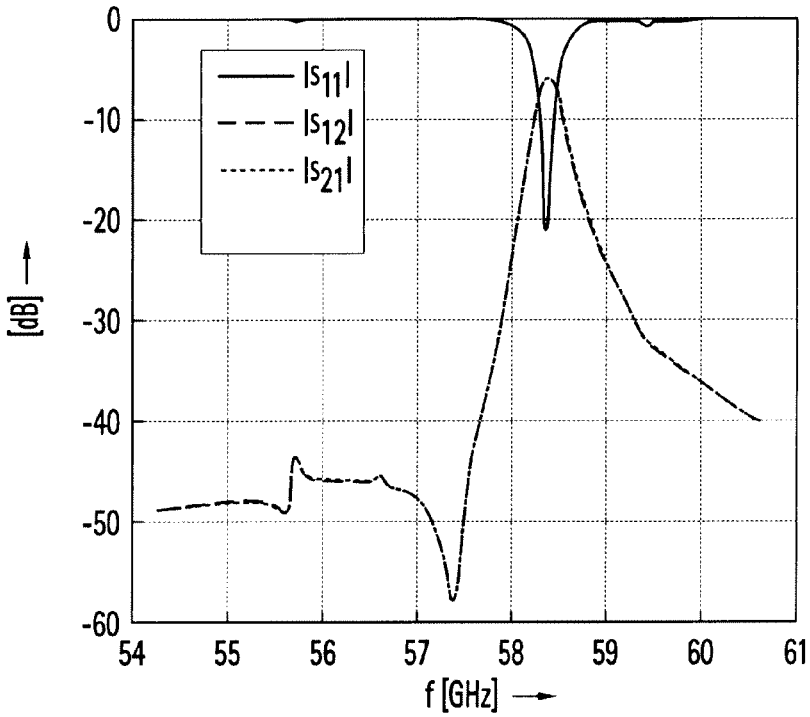
FIG. 16 shows a resonance characteristic of the magnetic filter according to the invention dependent upon frequency.

FIG. 16 shows a resonance characteristic of the aperture-coupled unilateral fin lines 7 dependent upon frequency according to the first exemplary embodiment of the magnetically-tunable filter 1 according to the invention.

In the resonance characteristic from FIG. 16, a significantly-reduced insertion loss is achieved in the pass-band range of the filter than is the case with the unshielded (suspended) stripline filter. Moreover, an improved isolation remote from the resonance frequency is provided for the unilateral fin lines 7, particularly in the case of an excitation with relatively-high frequencies. Furthermore, in spite of identical coupling in resonant conditions and relatively-higher isolation remote from the resonance frequency, the undesirable auxiliary resonance is significantly less prominent with the shielded unilateral fin line filter than with the inverse (suspended) stripline filter.

Figure 17:
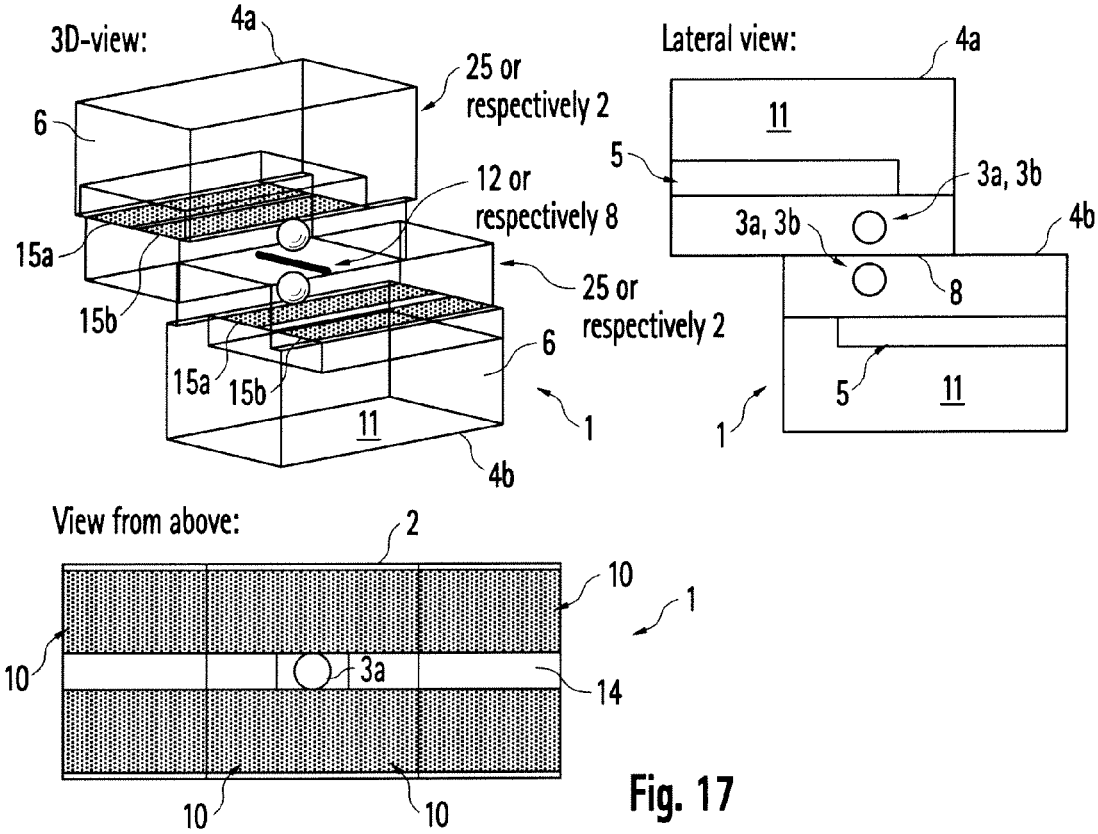
FIG. 17 shows a structure of the first exemplary embodiment of the magnetic field according to the invention, in which a slot-shaped aperture is used.

With the use of a coupling in the open-circuit region 17 and the use of unilateral fin lines 7, a significantly improved performance is achieved according to the invention by comparison with classic coupler structures using a coupling with a short-circuit region. In the first exemplary embodiment of the magnetically-tunable filter 1 according to the invention, the two waveguides 25 or respectively propagation channels are coupled via a slot-shaped coupling aperture or via a single gap 12. With the use of slot-shaped coupling apertures 12, the coupler structure illustrated in FIG. 17 is obtained. Here also, the coupling of the resonator spheres 3*a*, 3*b* is implemented via an open-circuit region. The DC magnetic field $H_0$ in this context is also perpendicular to the substrate layer 5.

Figure 20:
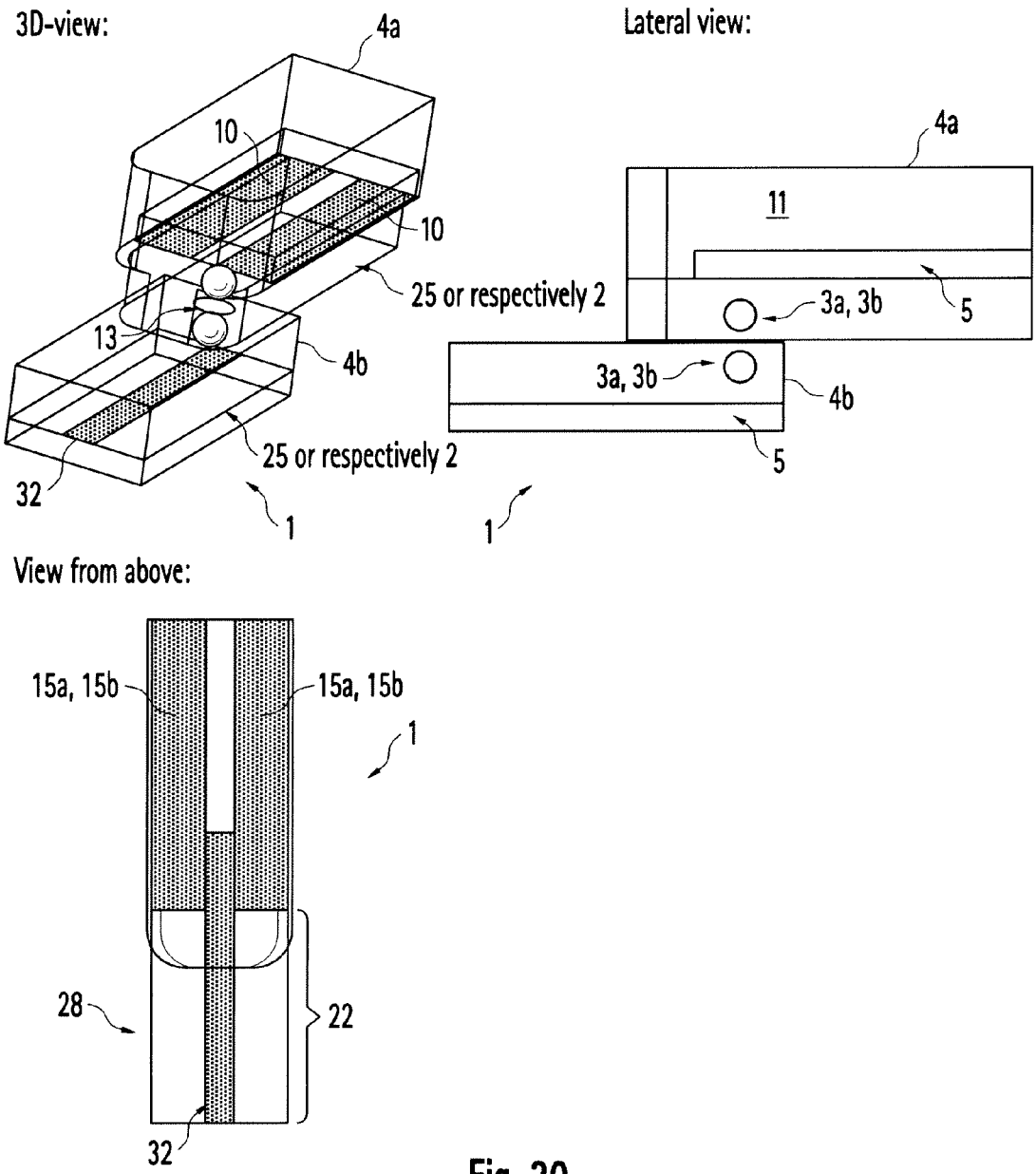
FIG. 20 shows a third exemplary embodiment of a magnetically-tunable filter according to the invention with a microstripline and a unilateral fin line using an apertured diaphragm.
Figure 21:
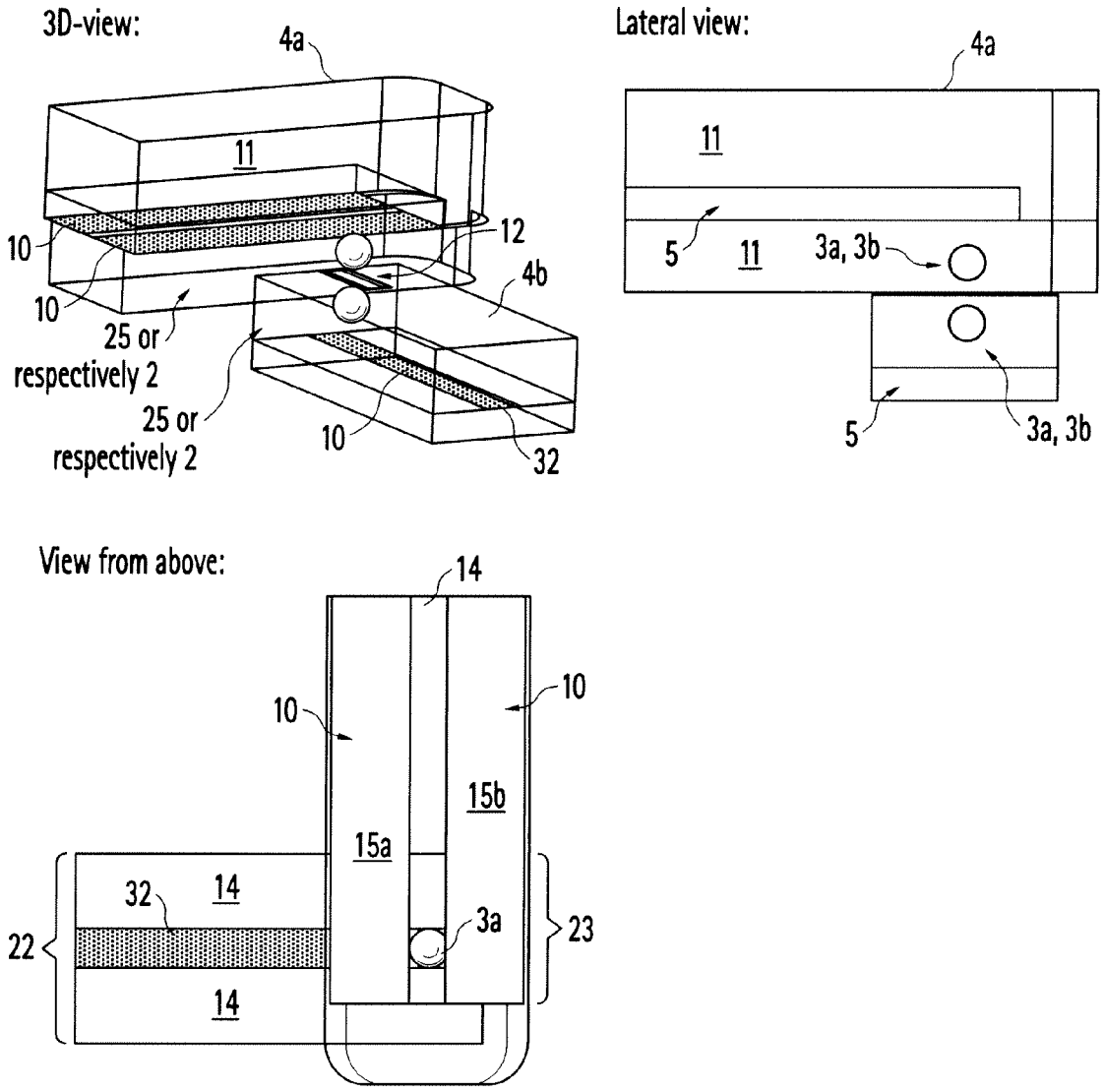
FIG. 21 shows a fourth exemplary embodiment of a magnetically-tunable filter according to the invention with a microstripline and a unilateral fin line using a slot-shaped aperture.

An increase in isolation can be implemented with both coupler structures from FIG. 9 and FIG. 17 by cascading, that is to say, through an appropriate, successive connection of each identical structure or by a combination of the different coupler structures as realized in the third and fourth exemplary embodiments of the invention (see FIGS. 20 and 21).

With both coupler structures from FIG. 9 and FIG. 17, the resonator spheres 3*a*, 3*b* are coupled at the connecting resonator, which is designed for the transport of an $H_{110}$ wave mode, either through the width of the slot or the single gap 12 between the lateral metallization 10 or through the spacing distance of the resonator spheres 3*a*, 3*b* relative to the substrate layer 5. For wide gaps 12 a relatively-stronger coupling of the resonator spheres 3*a*, 3*b* is implemented, because the electromagnetic wave travels further in the air than in the case of a narrow gap 12. The coupling between the resonator spheres 3*a*, 3*b* is adjusted according to FIG. 9 via the diameter of the apertured diaphragm 13 or respectively, according to FIG. 17, via the length and the width of the single gap 12.

Figure 18:
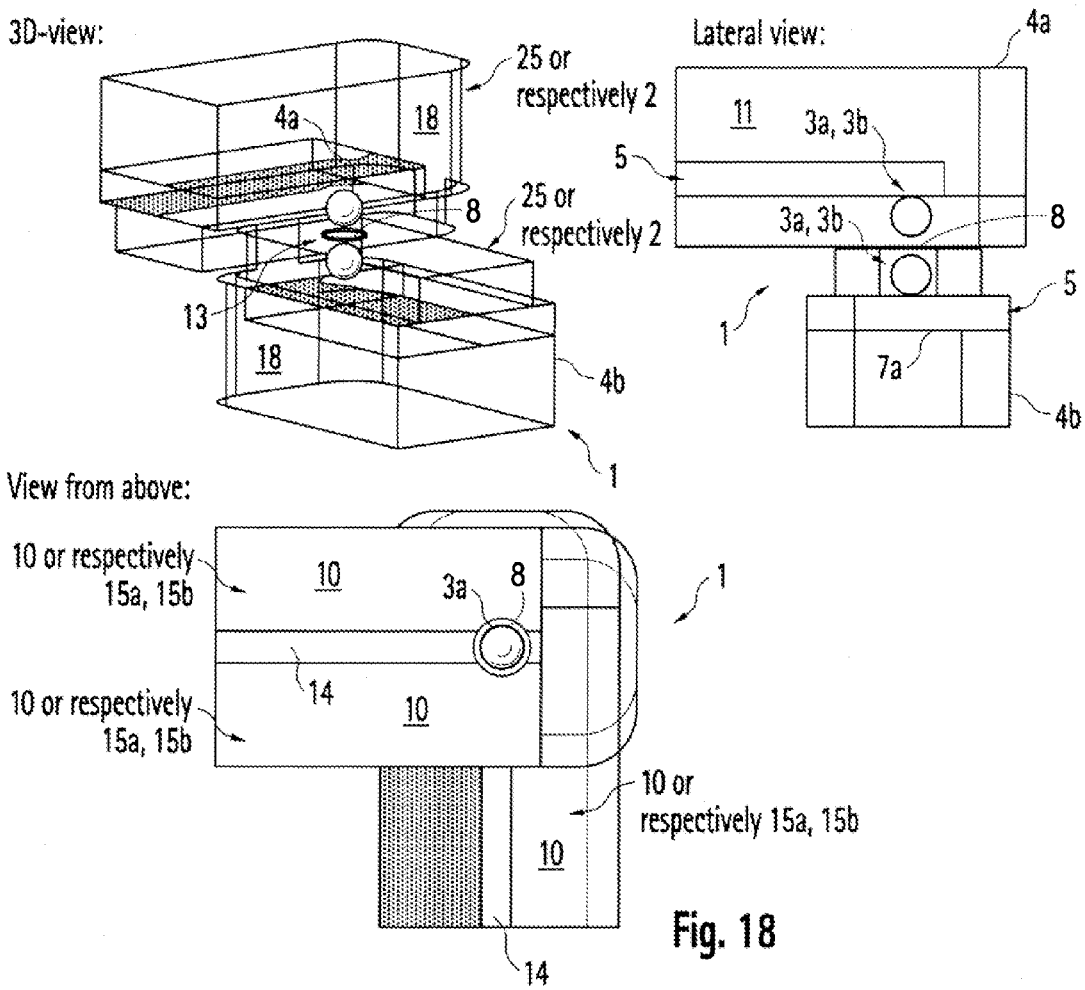
FIG. 18 shows a structure of the second exemplary embodiment of the magnetic filter according to the invention, in which an apertured diaphragm is used.

FIG. 18 shows a structure of the second exemplary embodiment of the magnetic filter 1 according to the invention, wherein a similar apertured diaphragm 13 is used. The difference by comparison with the first exemplary embodiment is that the magnetically-tunable filter 1 according to the invention provides antipodal fin lines 7*a*. By contrast with the unilateral fin line 7, the lateral metallization 10 in the antipodal fin line 7*a* are attached to opposing sides of the substrate 16*a*, 16*b*. The substrate layer 5 is disposed in two propagation channels or waveguides 25 milled or eroded from metal, which are connected to one another exclusively via a coupling aperture 8, which is provided as a circular opening or respectively as an apertured diaphragm 13. The coupling aperture 8 can also be designed as an ellipse, a rectangle or a triangle. Moreover, the coupling aperture 8 can at least also be designed as a single gap 12 or as a multiple gap, for example, a double gap or a two-fold double gap 29.

The resonator spheres 3*a*, 3*b* are positioned on opposite sides of the apertured diaphragm 13 in the open-circuit region of the fin line 7 or of the fin lines 7. With this coupler structure also, the resonator spheres 3*a*, 3*b* are also coupled via the open-circuit region 17, because the characteristic of the magnetic field is very similar to the field characteristic of a unilateral fin line 7. The magnetic field energy in the case of the antipodal fin line is preferably guided within the substrate layer 5, which accounts for the difference by comparison with the use of a unilateral fin line 7. For this reason, the resonator spheres 3*a*, 3*b* are attached or glued directly to the substrate layer 5. Accordingly, no sphere mountings are required in this structure. To allow an accurate positioning of the resonator spheres 3*a*, 3*b* on the substrate layer 5, circular contours 24 have been provided in the lateral metallization 10.

By contrast with the classic antipodal fin line 7*a*, in which the substrate layer 5 is attached in the middle of the waveguide 25 surrounding the latter, the substrate layer 5 is displaced in the direction towards the coupling aperture 8, so that the substrate layer 5 is disposed within the filter arms 4*a*, 4*b* in each case asymmetrically relative to a central plane 21 of the respective filter arm 4*a*, 4*b*. Because of this arrangement, the spacing distance between the substrate layer 5 and the coupling aperture 8 is reduced in order to guarantee a good coupling between the resonator spheres 3*a*, 3*b* in resonant conditions.

As a result of the concentration of the magnetic field energy in the substrate layer 5, the overall height of the structure of the second exemplary embodiment can be further reduced by comparison with the first exemplary embodiment with the unilateral fin line 7, so that the magnetically-tunable filter 1 according to the second exemplary embodiment of the invention can be more readily integrated into a narrow slot between the pole shoes of an electromagnet.

Moreover, the propagation channel or respectively the waveguide 25 in the second exemplary embodiment is stepped in order to allow a stable support of the substrate layer 5 on the relatively-smaller cuboid 20*b* of the filter housing 2. The fixing of the substrate layer 5 in the propagation channel or respectively the waveguide 25 is realized, for example, by means of a conductive adhesive, which is applied to the lateral edges 26 at the limit between the relatively-smaller cuboid 20*b* and a relatively-larger cuboid 20*a*. Furthermore, soldering with indium solder ensures a conductive connection of the lateral metallization 10 to the propagation channel surrounding it, thereby preventing the propagation of undesirable modes. The DC magnetic field $H_0$ is also disposed perpendicular on the substrate layer 5.

With the second exemplary embodiment, a use of an antipodal fin line 7*a* in a magnetically-tunable filter 1 according to the invention also allows a coupling of the resonator spheres 3*a*, 3*b* via a slot-shaped coupling aperture 8 or apertured diaphragm. In this case, with the structure from FIG. 17, only the substrate layers 5 with the unilateral line structure need to be replaced by substrate layers 5 with antipodal line structure 7*a*.

An increase of isolation is also possible through appropriate cascading of the coupling structures. The coupler structures from FIGS. 9 and 17 can also be built up through the use of bilateral fin lines. In the case of the bilateral fin lines, the resonator spheres 3*a*, 3*b* are also coupled via an open-circuit region 17. However, this embodiment is not illustrated in the drawings.

Figure 19:
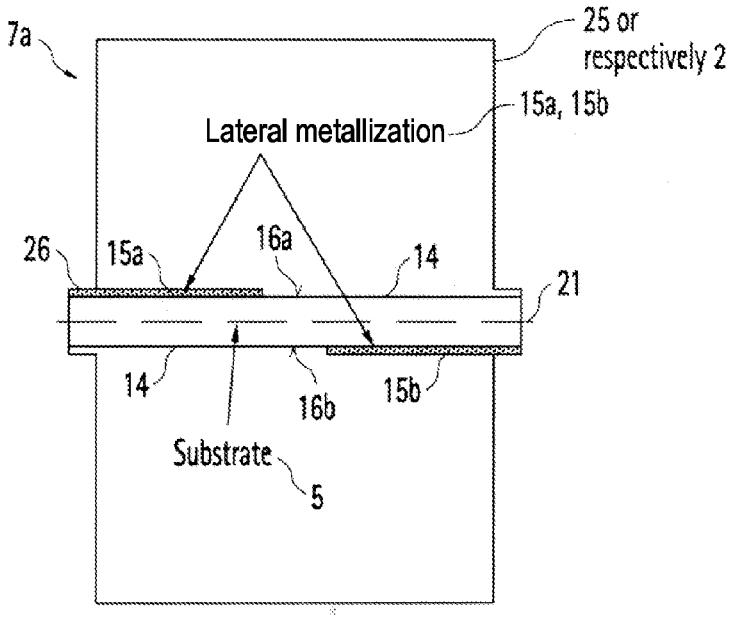
FIG. 19 shows an exemplary cross-section through an antipodal fin line as used in the filter according to the invention.

FIG. 19 shows an exemplary cross-section through an antipodal fin line 7*a*, wherein two metal strips 15*a*, 15*b* or metallization 10 separated by the non-conductive substrate layer 5 are arranged in a mutually-symmetrical manner on mutually-opposing surfaces 16*a*, 16*b* of the substrate layer 5.

FIG. 20 shows a third exemplary embodiment of a magnetically-tunable filter 1 according to the invention with a microstripline 22 and a unilateral fin line 7 using a apertured diaphragm 13 as the coupling aperture 8 between the two filter arms 4*a*, 4*b*. The waveguides are disposed in two propagation channels milled or eroded into metal, which are connected to one another exclusively via a coupling aperture 8 according to the invention. The resonator spheres 3*a*, 3*b* are positioned on opposite sides of the coupling aperture 8 in the open-circuit region 17 of the fin line 7 or respectively in the short-circuit region of the microstripline 22. Since the field line images of a unilateral fin line 7 and a microstripline are orthogonal, a stretched structure 28 is obtained through the use of the iris-shaped coupling aperture 8 (apertured diaphragm 13) in the third exemplary embodiment of the filter 1 according to the invention.

Since the two resonator spheres 3*a*, 3*b* are subjected to different marginal conditions with reference to the characteristic of the magnetic field, the possibility of rotating at least one of the two resonator spheres 3*a*, 3*b* is provided. Different marginal conditions in the field characteristic lead to offset resonance frequencies of the individual resonator spheres 3*a*, 3*b*, thereby increasing the insertion loss in the pass-band range of the relevant filter. It is possible through targeted rotations of the resonator spheres 3*a*, 3*b* to adjust the position of the resonance frequency of the individual resonator spheres 3*a*, 3*b* within a certain frequency range.

FIG. 21 shows a fourth exemplary embodiment of the magnetically-tunable filter 1 according to the invention with a microstripline 22 and a unilateral fin line 7 using a slot-shaped diaphragm 12 as the coupling aperture 8. With this exemplary embodiment, the resonator spheres 3*a*, 3*b* are arranged one above the other in two filter arms 4*a*, 4*b* with a different internal structure 9.

In further exemplary embodiments of the present invention, the use of a coplanar line with or without ground instead of the microstripline 22 is also provided. In yet further exemplary embodiments, the fin line 7 in the second filter arm 4*b* is replaced by a (suspended) stripline or an inverse (suspended) stripline. The unilateral fin line 7 can also be replaced by an antipodal fin line 7*a*, or a bilateral fin line. As already mentioned, it is possible to increase the isolation by cascading with an identical coupling structure or with different coupling structures. With the coupling structures illustrated in FIGS. 9, 17, 18, 20 and 21, the coupling aperture 8 can also be realized by polygonal outlines of any shape.

Figure 22:
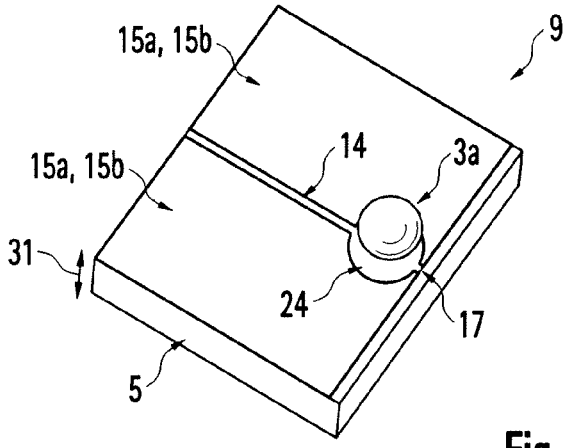
FIG. 22 shows a unilateral fin line with a recess within the metallization for use in a magnetically-tunable filter according to the invention.

FIG. 22 shows a unilateral fin line 7 without a surrounding waveguide 25. The unilateral fin line 7 provides a recess 24, which is formed within the metallization 10. This structure is also provided for a use in the magnetically-tunable filter 1 according to the invention.

Figure 23:
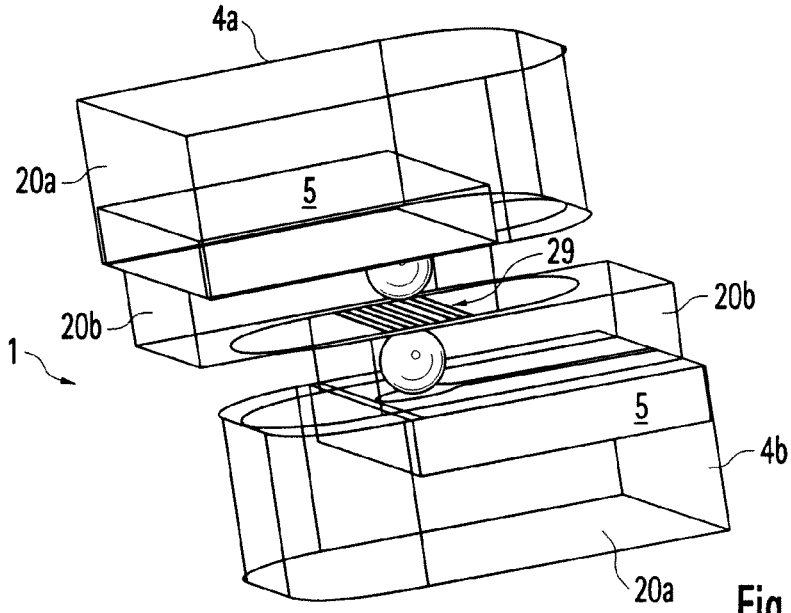
FIG. 23 shows a fifth exemplary embodiment of a magnetically-tunable filter according to the invention with a unilateral fin line using a slot-shaped aperture, which is designed as a two-fold double gap.

FIG. 23 shows a fifth exemplary embodiment of a magnetically-tunable filter 1 according to the invention with a unilateral fin line 7 in each of the two filter arms 4*a*, 4*b*, wherein a slot-shaped diaphragm, which is designed as a two-fold double gap 29, is provided as the coupling aperture 8 between the 2 filter arms 4*a*, 4*b*.

FIG. 24 once again shows the fifth exemplary embodiment from FIG. 3 of a magnetically-tunable filter 1 according to the invention in a plan view. This exemplary embodiment provides one unilateral fin line 7 in each filter arm 4*a*, 4*b*.

Figure 24:
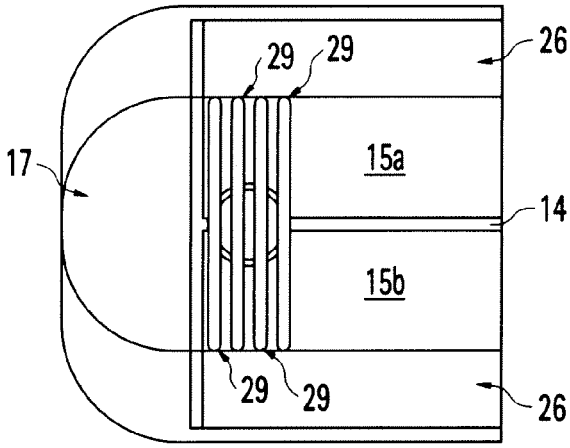
FIG. 24 shows a plan view of the fifth exemplary embodiment of a magnetically-tunable filter according to the invention from FIG. 23 with a unilateral fin line in both filter arms using a slot-shaped aperture, which is designed as a two-fold double gap.
Figure 25:
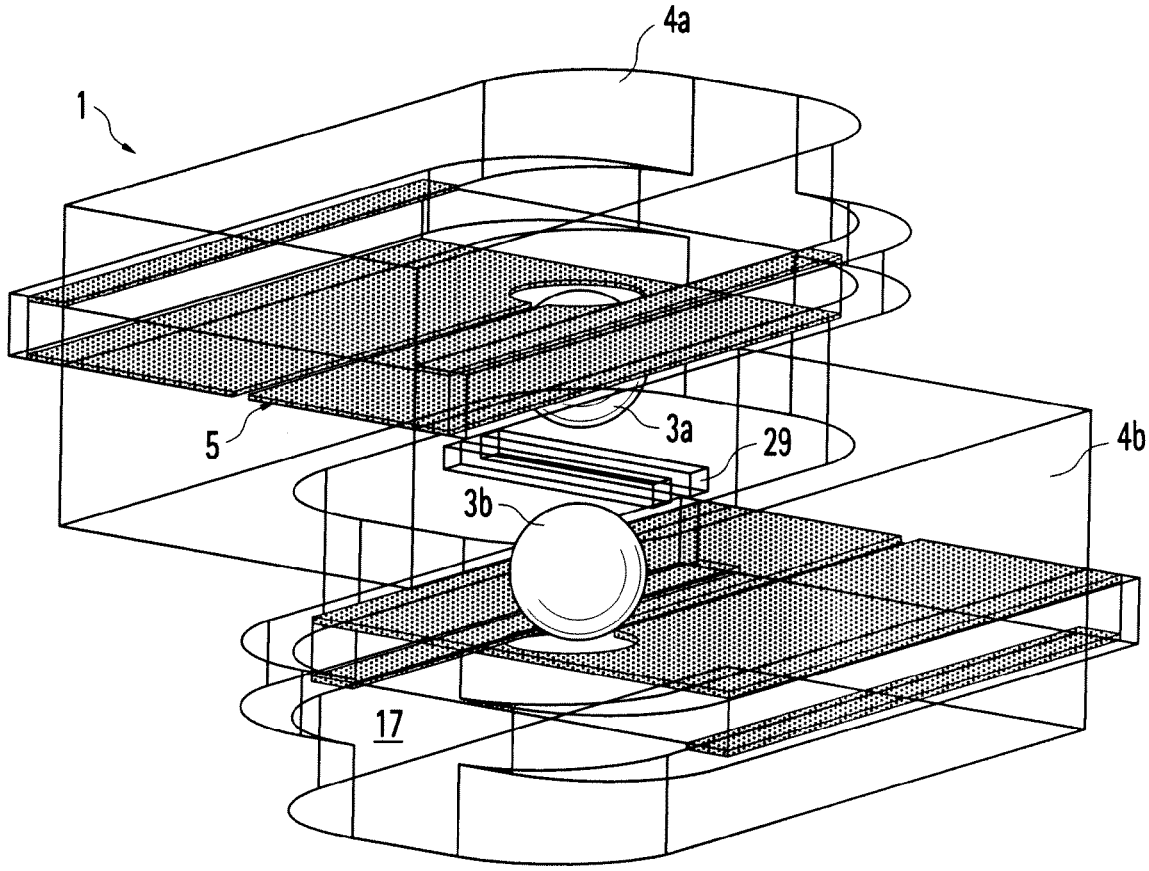
FIG. 25 shows a perspective, 3-D view of the fifth exemplary embodiment from FIGS. 23 and 24 with a substrate layer made of TEFLON (Polytetrafluoroethylene)

FIG. 25 shows a perspective 3-D view of the fifth exemplary embodiment from FIGS. 23 and 24, wherein TEFLON (Polytetrafluoroethylene), which can be readily attached by clamping in a waveguide 25, is used as the substrate layer 5.

Figure 26:
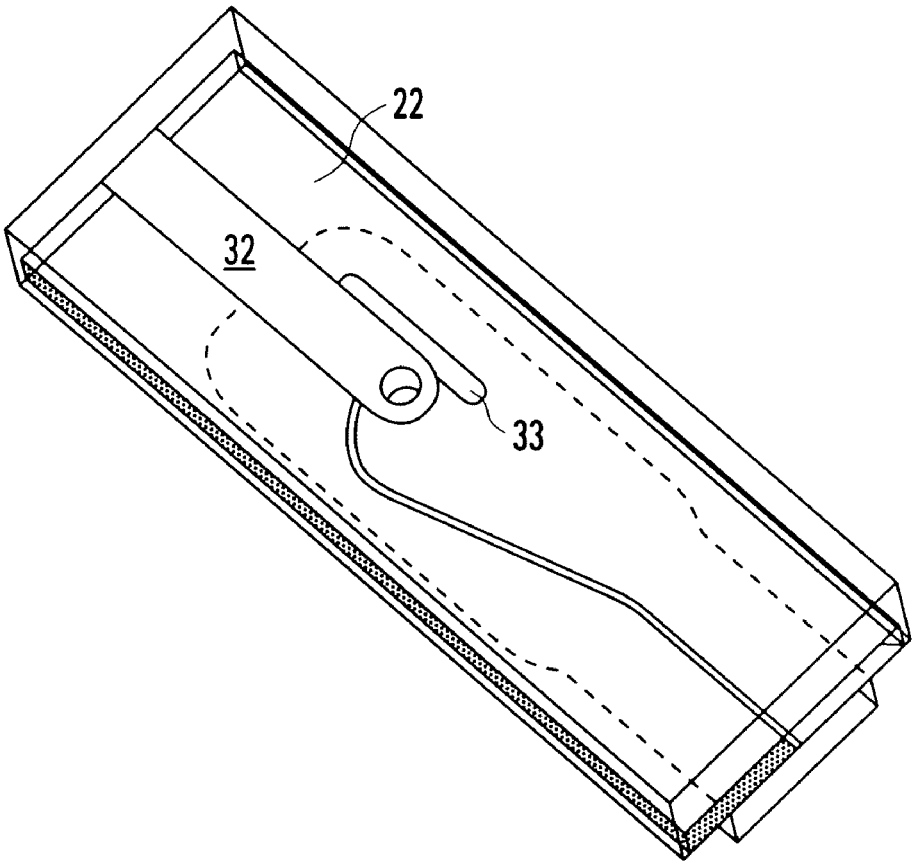
FIG. 26 shows a perspective, 3-D view of the transition of the microstripline to the fin line or slot line of the fourth exemplary embodiment of the filter according to the invention.

FIG. 26 shows a perspective 3-D view of a transition 30 of the microstripline 22 onto the fin line 7 or respectively slot line of the fourth exemplary embodiment of the filter 1 according to the invention. The middle conductor 32 of the microstripline 22 in this context is short-circuited.

Figure 27:
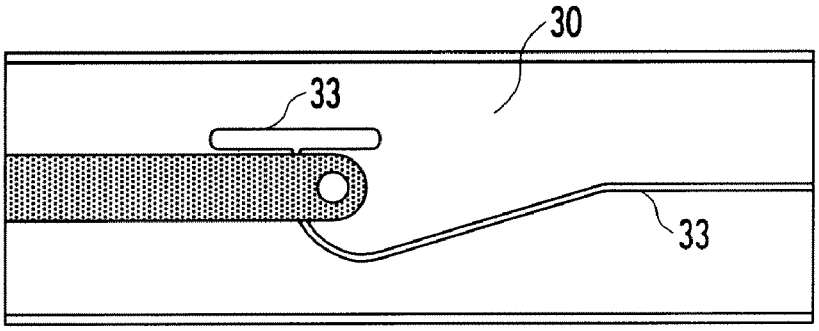
FIG. 27 shows a plan view of the transition illustrated in FIG. 26.
Figure 28:
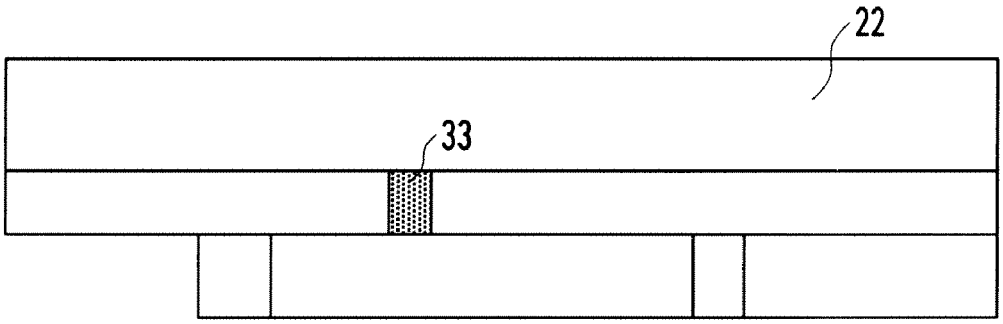
FIG. 28 shows a lateral view of the transition illustrated in FIG. 26.
Figure 29:
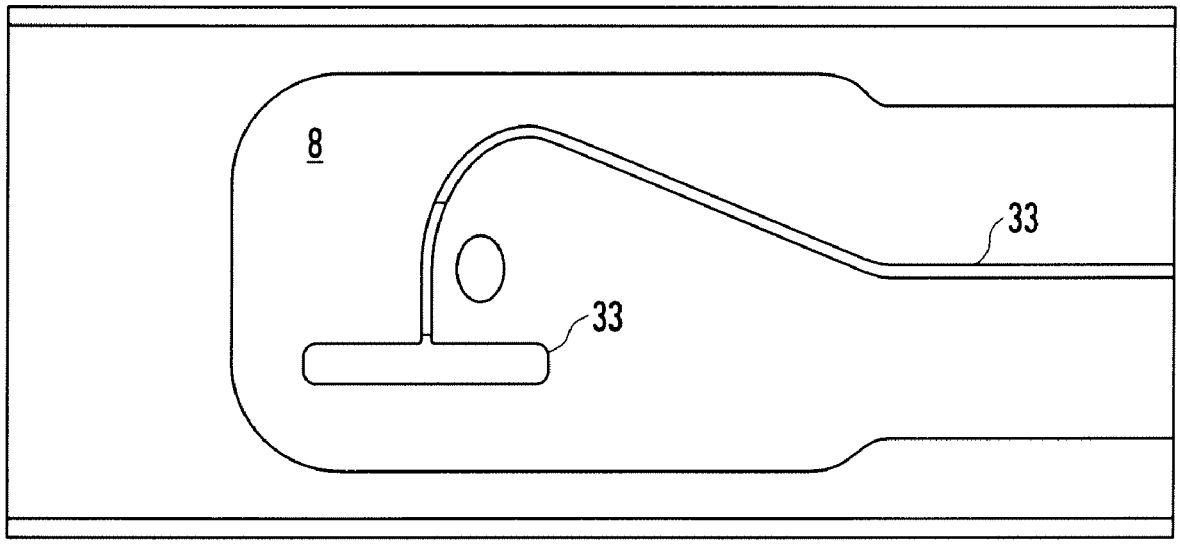
FIG. 29 shows of view of the transition illustrated in FIG. 26 from the underside.

FIG. 27 shows a plan view of the transition 30 illustrated in FIG. 26; and FIG. 28 shows a lateral view of the transition 30 illustrated in FIG. 26. FIG. 29 shows a view of the transition 30 illustrated in FIG. 26 from the underside.

Tunable band-pass filters, of which the centre frequency can be adjusted as required over a given frequency range, are required in many areas of high-frequency technology. The construction of a magnetically-tunable band-pass filter according to the present invention requires a coupler structure for coupling the resonator spheres 3*a*, 3*b*, which guarantees that a high decoupling/isolation remote from the resonance frequency is provided between the filter input and filter output. At the same time, the coupler structure must guarantee a high energy transfer from the input to the output in resonant conditions. In resonant conditions, the invention achieves high isolation and at the same time a high energy transfer at frequencies far above 70 GHz to 110 GHz.

The invention is not restricted to the exemplary embodiments illustrated in the drawings, in particular, the invention is not restricted to spherical resonators made of a ferrite. All the features described above and presented in the drawings can be combined with one another as required.

The invention claimed is:

1. A magnetically-tunable filter comprising a filter housing with two tunable resonator spheres made of a magnetizable material, which are arranged one above the other in two filter arms, wherein at least one of the two filter arms contains a substrate layer, which provides a fin line extending in a direction toward an electrical contact, wherein the two filter arms are connected by a common coupling aperture, and a corresponding resonator sphere of the two tunable resonator spheres is positioned within each of the two filter arms on each side of the coupling aperture and wherein the coupling aperture is common to the two filter arms and comprises an apertured diaphragm in combination with at least one single gap.

2. The magnetically-tunable filter according to claim 1, wherein each of the two filter arms provides an internal structure defined by a sequence of the substrate layer, a metallization layer and an air layer.

3. The magnetically-tunable filter according to claim 2, wherein each filter arm is composed respectively of a relatively-larger cuboid and a relatively-smaller cuboid.

4. The magnetically-tunable filter according to claim 3, wherein the substrate layer comprises additional layers and the sequence of the substrate layer, the metallization layer, and the air layer is implemented on the relatively-smaller cuboid.

5. The magnetically-tunable filter according to claim 1, wherein the coupling aperture is circular, elliptical, rectangular, triangular, or polygonal.

6. The magnetically-tunable filter according to claim 1, wherein the two filter arms are arranged one above the other within the filter housing.

7. The magnetically-tunable filter according to claim 1, wherein the fin line is unilateral, wherein the unilateral fin line includes two metal strips separated by a non-conductive strip are disposed on a first surface of the substrate layer.

8. The magnetically-tunable filter according to claim 1, wherein the fin line is bilateral, wherein the bilateral fin line includes two metal strips separated by a non-conductive strip are disposed on a first surface of the substrate layer, and at the same time, a second surface of the substrate layer provides at least one metal strip.

9. The magnetically-tunable filter according to claim 1, wherein the fin line is antipodal, wherein the antipodal fin line includes two metal strips separated by a non-conductive substrate layer are disposed symmetrically relative to one another on mutually-opposing surfaces of the substrate layer.

10. The magnetically-tunable filter according to claim 1, wherein in each of the two filter arms includes a respective one of said at least one substrate layer and each substrate layer is arranged asymmetrically relative to a central plane of the respective ones of the two filler arms.

11. The magnetically-tunable filter according to claim 10, wherein the substrate layer in each of the two filter arms is displaced parallel to the central plane of the respective filter arm in the direction towards the coupling aperture.

12. The magnetically-tunable filter according to claim 1, wherein the substrate layer provides a low relative dielectric constant $\in_r$.

13. The magnetically-tunable filter according to claim 1, wherein the substrate layer is made of polytetrafluoroethylene.

14. The magnetically-tunable filter according to claim 1, wherein the magnetizable material is a ferrimagnetic material or a ferromagnetic material.

15. The magnetically-tunable filter according to claim 1, wherein the two tunable resonator spheres provide a respective diameter of 100 μm to 1000 μm.

16. The magnetically-tunable filter according to claim 1, wherein the two tunable resonator spheres are disposed in mirror-image symmetry relative to one another on both sides of the coupling aperture.

17. The magnetically-tunable filter according to claim 1, wherein the two tunable resonator spheres are each fixed within the two filter arms by a mounting made of a non-conductive material.

18. The magnetically-tunable filter according to claim 1, wherein each of the two filter arms includes a respective one of said at least one substrate layer and the corresponding resonator sphere in each of the two filter arms is glued to the corresponding substrate layer.

19. A magnetically-tunable filter comprising a filter housing with two tunable resonator spheres made of a magnetizable material, which are arranged one above the other in two filter arms, wherein at least one of the two filter arms contains a substrate layer, which provides a fin line extending in a direction toward an electrical contact, wherein the two filter arms are connected by a common coupling aperture, and a corresponding resonator sphere of the two tunable resonator spheres is positioned within each of the two filter arms on each side of the coupling aperture, wherein each of the two filter arms provides an internal structure defined by a sequence of the substrate layer, a metallization layer and an air layer, wherein the two tunable resonator spheres comprising the magnetizable material are disposed one above the other in the two filter arms with, and wherein the internal structure of each of the two filter arms is different from one another.

20. The magnetically-tunable filter according to claim 19, wherein the other of the two filter arms contains a microstripline.

21. The magnetically-tunable filter according to claim 19, wherein the other of the two filter arms contains a shielded stripline.

22. The magnetically-tunable filter according to claim 19, wherein the other of the two filter arms contains an inverse shielded stripline.

23. A magnetically-tunable filter comprising a filter housing with two tunable resonator spheres made of a magnetizable material, which are arranged one above the other in two filter arms, wherein at least one of the two filter arms contains a substrate layer, which provides a fin line extending in a direction toward an electrical contact, wherein the two filter arms are connected by a common coupling aperture, and a corresponding resonator sphere of the two tunable resonator spheres is positioned within each of the two filter arms on each side of the coupling aperture, wherein a substrate layer in each of the two filter arms is arranged asymmetrically relative to a central plane of the respective filter arm of said two filter arms, and wherein at least one of the substrate layers provides a fin line extending in a direction toward an electrical contact.

24. The magnetically-tunable filter according to claim 23, wherein each of the two filter arms provides an internal structure defined by a sequence of the substrate layer, a metallization layer and an air layer.

25. The magnetically-tunable filter according to claim 24, wherein each of the two filter arms is composed respectively of a relatively-larger cuboid and a relatively-smaller cuboid.

26. The magnetically-tunable filter according to claim 25, wherein the substrate layer comprises additional layers and the sequence of the substrate layer, the metallization layer, and the air layer is implemented on the relatively-smaller cuboid.

27. The magnetically-tunable filter according to claim 23, wherein the common coupling aperture is formed at least as a single gap.

28. The magnetically-tunable filter according to claim 23, wherein the common coupling aperture is formed as an apertured diaphragm.

29. The magnetically-tunable filter according to claim 23, wherein the coupling aperture is circular, elliptical, rectangular, triangular, or polygonal.

30. The magnetically-tunable filter according to claim 23, wherein the two filter arms are arranged one above the other within the filter housing.

31. The magnetically-tunable filter according to claim 23, wherein the fin line is unilateral, wherein the unilateral fin line includes two metal strips separated by a non-conductive strip are disposed on a first surface of the substrate layer.

32. The magnetically-tunable filter according to claim 31, wherein the corresponding resonator sphere within each of the two filter arms is disposed in the proximity of an open-circuit region of the two metal strips, wherein the open-circuit region isolates the metal strips at their ends, wherein the isolation of the metal strips is relative to one other and also relative to one wall of the filter housing.

33. The magnetically-tunable filter according to claim 23, wherein the fin line is bilateral, wherein the bilateral fin line includes two metal strips separated by a non-conductive strip are disposed on a first surface of the substrate layer, and at the same time, a second surface of the substrate layer provides at least one metal strip.

34. The magnetically-tunable filter according to claim 23, wherein the fin line is antipodal, wherein the antipodal fin line includes two metal strips separated by a non-conductive substrate layer are disposed symmetrically relative to one another on mutually-opposing surfaces of the substrate layer.

35. The magnetically-tunable filter according to claim 23, wherein the substrate layer in each of the two filter arms is displaced parallel to the central plane of the respective filter arm of the two filter arms in the direction towards the coupling aperture.

36. The magnetically-tunable filter according to claim 23, wherein each substrate layer provides a low relative dielectric constant $\in_r$.

37. The magnetically-tunable filter according to claim 23, wherein the substrate layer is made of polytetrafluoroethylene.

38. The magnetically-tunable filter according to claim 23, wherein the magnetizable material is a ferrimagnetic material or a ferromagnetic material.

39. The magnetically-tunable filter according to claim 23, wherein the two tunable resonator spheres provide a respective diameter of 100 μm to 1000 μm.

40. The magnetically-tunable filter according to claim 23, wherein the two tunable resonator spheres are disposed in mirror-image symmetry relative to one another on both sides of the coupling aperture.

41. The magnetically-tunable filter according to claim 23, wherein the two tunable resonator spheres are each fixed within the two filter arms by a mounting made of a non-conductive material.

42. The magnetically-tunable filter according to claim 23, wherein the corresponding resonator sphere in each of the two filter arms is glued to the corresponding substrate layer.

* * * * *